US010204570B2

(12) United States Patent
Yamazaki

(10) Patent No.: US 10,204,570 B2
(45) **Date of Patent: *Feb. 12, 2019**

(54) STORAGE TYPE DISPLAY DEVICE AND ELECTRONIC APPARATUS

(71) Applicant: E Ink Corporation, Billerica, MA (US)

(72) Inventor: Katsunori Yamazaki, Matsumoto (JP)

(73) Assignee: E Ink Corporation, Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/183,546

(22) Filed: Jun. 15, 2016

(65) Prior Publication Data

US 2016/0372054 A1 Dec. 22, 2016

(30) Foreign Application Priority Data

Jun. 22, 2015 (JP) ..... 2015-124855

(51) Int. Cl.
*G09G 3/34* (2006.01)

(52) U.S. Cl.
CPC ..... *G09G 3/344* (2013.01); *G09G 2300/0426* (2013.01); *G09G 2310/0275* (2013.01); *G09G 2310/0281* (2013.01); *G09G 2310/04* (2013.01); *G09G 2310/06* (2013.01); *G09G 2320/0252* (2013.01); *G09G 2330/021* (2013.01)

(58) Field of Classification Search
CPC ..... G09G 3/344–3/3453; G09G 2300/0421; G09G 2300/0426; G09G 2300/0473; G09G 2300/0842–2300/0866; G09G 2310/0275; G09G 2310/0281; G09G 2310/0289; G09G 2310/04; G09G 2310/06; G09G 2310/068; G09G 2320/0252; G09G 2330/021; G09G 2330/023

See application file for complete search history.

(56) References Cited

U.S. PATENT DOCUMENTS

2008/0238867 A1 10/2008 Maeda et al.
2009/0015570 A1* 1/2009 Yamazaki ..... G09G 3/3677 345/204
2009/0109158 A1* 4/2009 Shirai ..... G09G 3/3655 345/94

(Continued)

FOREIGN PATENT DOCUMENTS

JP 2009-258614 A 11/2009
JP 2010-256919 A 11/2010

*Primary Examiner* — Nathan Danielsen
(74) *Attorney, Agent, or Firm* — Zhen Bao

(57) ABSTRACT

A storage type display device including: first control lines that are provided in as many as n columns; second control lines that are provided in as many as m rows; and a display section that includes n×m pixels. The device further includes a branched power supply line that supplies power to the pixel electrode in each row; a stem power supply line; a pixel electrode switching circuit; a power supply line switching circuit that is connected between the stem power supply line and the branched power supply line; and a scanning line driving circuit that outputs a signal to the second control lines. The scanning line driving circuit is arranged in a predetermined end side of the display section, and the power supply line switching circuit is arranged on another end side which is different from the predetermined end side of the display section.

18 Claims, 29 Drawing Sheets

(56) References Cited

U.S. PATENT DOCUMENTS

| | | | | |
|---|---|---|---|---|
| 2009/0189850 | A1* | 7/2009 | Murayama | G09G 3/344 345/107 |
| 2009/0237392 | A1 | 9/2009 | Kajino | |
| 2009/0256783 | A1* | 10/2009 | Mizukoshi | G09G 3/3233 345/76 |
| 2011/0096053 | A1* | 4/2011 | Yamazaki | G09G 3/344 345/107 |

* cited by examiner

STORAGE TYPE DISPLAY DEVICE AND ELECTRONIC APPARATUS

BACKGROUND

1. Technical Field

The present invention relates to a storage type display device and an electronic apparatus.

2. Related Art

It has been known that, if an electric field is applied to a dispersion system in which charged corpuscles are dispersed in liquid, the charged corpuscles move (migrate) in the liquid. The phenomenon is referred to as electrophoresis. In the recent years, electrophoretic display devices, in which desired information (image) is displayed using electrophoresis, generally have begun to become widespread.

For example, JP-A-2010-256919 discloses an electrophoretic display device which includes a pixel electrode, a counter electrode, and a microcapsule-type electrophoretic element which includes microcapsules arranged between the pixel electrode and the counter electrode. The microcapsule is enclosed with a dispersion medium which disperses electrophoretic particles in the microcapsule, a plurality of white particles, and a plurality of black particles.

In the device disclosed in JP-A-2010-256919, a memory is installed for each pixel, and a voltage, which is applied to the pixel electrode, is set according to the content of the memory. Specifically, in a case in which any one of a plurality of branched power supply lines is connected to the pixel electrode according to the content of the memory, the voltage, which is supplied to the power supply line, is applied to the pixel electrode. The plurality of branched power supply lines in the respective rows are connected to a plurality of common stem power supply lines, and thus a voltage is supplied to the plurality of branched power supply lines in the respective rows from the plurality of stem power supply lines.

Therefore, for example, in a case in which display is changed in only a partial row, a voltage, which is necessary for the change, is supplied to the plurality of stem power supply lines, and thus the voltage is supplied to a plurality of branched power supply lines in all the rows. As a result, a complicated sequence is necessary to cause display in rows, in which display is not changed, to not be changed and the rewriting time becomes long. In addition, it is necessary to rewrite the content of the memories in the rows in which display is not changed, thereby resulting in an increase in electric power consumption.

SUMMARY

An advantage of some aspects of the invention is to provide a storage type display device and an electronic apparatus that can realize a reduction in time which is necessary to write a data signal to pixel electrodes and a reduction in electric power consumption in a case in which only some rows are rewritten.

The invention can be realized in the following aspects or application examples.

According to an aspect of the invention, there is provided a storage type display device including: first control lines that are provided in as many as n (n is an integer which is equal to or larger than 2) columns; second control lines that are provided in as many as m (m is an integer which is equal to or larger than 2) rows; and a display section that includes display elements interposed between a pair of substrates and includes n×m pixels, in which the display section includes a pixel electrode which is formed for each pixel, a counter electrode which faces a plurality of pixel electrodes through the display elements, a pixel switching element which is connected to the first control lines and the second control lines and switches a power supply application state for the pixel electrode, and a pixel memory circuit which is connected to the pixel switching element, and in which the storage type display device further includes: a branched power supply line that supplies power to the pixel electrode in each row; a stem power supply line that supplies power to the branched power supply line which is commonly provided for the branched power supply line in each row; a pixel electrode switching circuit that switches a connection state between the branched power supply line and the pixel electrode according to content which is stored in the pixel memory circuit; a power supply line switching circuit that is connected between the stem power supply line and the branched power supply line in each row, and that selects the connection state between the stem power supply line and the branched power supply line in each row; a control circuit that disconnects or connects the stem power supply line from or to the branched power supply line for each row according to whether or not the content which is stored in the pixel memory circuit is rewritten; and a scanning line driving circuit that outputs a signal to the second control lines, in which the scanning line driving circuit is arranged in a predetermined end side of the display section, and in which the power supply line switching circuit is arranged on another end side which is different from the predetermined end side of the display section.

Therefore, in a case in which the content which is stored in the pixel memory circuit is rewritten, the branched power supply line may be connected to the stem power supply line by a control circuit according to the row corresponding to the pixel memory circuit. In addition, in the case in which the content which is stored in the pixel memory circuit is not rewritten, the branched power supply line may be disconnected from the stem power supply line by the control circuit in the row corresponding to the pixel memory circuit. Rewriting of the content of the pixel memory circuit is performed in such a way that the pixel switch, which is connected to the pixel memory circuit by the second control lines, is set to an ON state and a data signal according to rewriting is supplied from the first control lines which are connected to the pixel switch. In a case in which, for example, a data signal at a high level is written into the pixel memory circuit, the pixel electrode switching circuit causes the branched power supply line, which is used to supply a voltage corresponding to the high level, and the pixel electrode to be in a connection state. In the row corresponding to the pixel memory circuit in which rewriting is performed, the branched power supply line is connected to the stem power supply line. Therefore, a voltage corresponding to the high level is supplied to the branched power supply line, which is used to supply the voltage corresponding to the high level, from the stem power supply line to which the voltage corresponding to the high level is supplied, with the result that the voltage corresponding to the high level is applied to the pixel electrode, and thus rewriting is performed according to the content of the pixel memory circuit. In addition, in a case in which a data signal at a low level is written into the pixel memory circuit, the branched power supply line, which is used to supply a voltage corresponding to the low level, and the pixel electrode are in the connection state. In the row corresponding to the pixel memory circuit in which rewriting is performed, the branched power supply line is connected to the stem power supply line, and thus the voltage corresponding to the low level is supplied from the stem power supply line, to which the voltage corresponding to the low level is supplied, to the branched power supply line, which is used to supply the voltage corresponding to the low level. Therefore the voltage corresponding to the low level is applied to the pixel electrode, and thus rewriting is performed according to the content of the pixel memory circuit. In contrast, in a case in which the content of the pixel memory circuit is not rewritten, the branched power supply line is disconnected from the stem power supply line in the row corresponding to the pixel memory circuit. Therefore, even in a case in which the pixel electrode switching circuit causes the branched power supply line and the pixel electrode to be in a connection state according to the content of the pixel memory circuit, the voltage is not supplied to the branched power supply line, and thus, finally, the voltage is not applied to the pixel electrode. Therefore, in the row corresponding to the memory circuit, display is not changed. As described above, the branched power supply line may be connected to the stem power supply line in only the row in which the content of the pixel memory circuit is rewritten, and the pixel switching element may be driven by the second control line, and thus the rewriting time is decreased and the electric power consumption is decreased.

In addition, the scanning line driving circuit is arranged on the predetermined end side of the display section, and the power supply line switching circuit is arranged on another end side which is different from the predetermined end side of the display section. Therefore, it is possible to cause the dimensions of frames (non-display areas), which are located on the predetermined end side of the display section and on another end side which is different from the predetermined end side, to be almost equal. In this case, in the case in which, for example, the scanning line driving circuit is arranged in one end side of the display section and the power supply line switching circuit is arranged on the other side of the display section, it is possible to cause the dimensions of the frames which are located on one end side and the other end side of display section to be almost equal.

Meanwhile, the first control lines are based on a concept that the first control lines include the data lines or the like, and may be provided in plural in each column. In addition, the second control lines are based on a concept that the second control lines include the scanning lines or the like, and may be provided in plural in each row. The display element is based on a concept that the display element includes an electrophoretic element, liquid crystal, an electrochromic element, and the like. The pixel switching element is based on a concept that the pixel switching element includes a transistor, and a transfer gate. The pixel memory circuit is based on a concept that the pixel memory circuit includes a capacitor, a latch circuit, and the like. A plurality of branched power supply lines may be provided in each row, and a plurality of stem power supply lines corresponding to the branched power supply lines may be provided.

In the storage type display device according to the aspect of the invention, the scanning line driving circuit and the power supply line switching circuit may be arranged through the display section along a row direction.

Therefore, it is possible to cause the dimensions of the frames (non-display areas) which are located on one end side and the other end side of display section in the row direction to be almost equal.

According to another aspect of the invention, there is provided a storage type display device including: first control lines that are provided in as many as n (n is an integer which is equal to or larger than 2) columns; second control lines that are provided in as many as m (m is an integer which is equal to or larger than 2) rows; and a display section that includes display elements interposed between a pair of substrates and includes n×m pixels, in which the display section includes a pixel electrode which is formed for each pixel, a counter electrode which faces the plurality of pixel electrodes through the display elements, a pixel switching element which is connected to the first control lines and the second control lines and switches a power supply application state for the pixel electrode, and a pixel memory circuit which is connected to the pixel switching element, and in which the storage type display device further includes: a branched power supply line that supplies power to the pixel electrode in each row; a stem power supply line that supplies power to the branched power supply line which is commonly provided for the branched power supply line in each row; a pixel electrode switching circuit that switches a connection state between the branched power supply line and the pixel electrode according to content which is stored in the pixel memory circuit; a power supply line switching circuit that is connected between the stem power supply line and the branched power supply line, and that is configured to include a plurality of unit power supply line switching circuits which select connection states between the stem power supply line and the branched power supply line; and a control circuit that disconnects or connects the stem power supply line from or to the branched power supply line according to whether or not the content which is stored in the pixel memory circuit is rewritten, in which the unit power supply line switching circuits are respectively arranged on one end side and the other end side of the display section in the row direction, and the unit power supply line switching circuits, which are arranged on one end side and the other end side, are connected to the branched power supply line on the same row.

Therefore, as described above, the rewriting time is decreased and the electric power consumption is decreased.

In addition, the unit power supply line switching circuits are respectively arranged on one end side and the other end side of the display section in the row direction, and the unit power supply line switching circuits, which are arranged on one end side and the other end side, are connected to the same row branched power supply line, and thus it is possible to dissolve or reduce display irregularities in the row direction of the display section.

According to still another aspect of the invention, there is provided a storage type display device including: first control lines that are provided in as many as n (n is an integer which is equal to or larger than 2) columns; second control lines that are provided in as many as m (m is an integer which is equal to or larger than 2) rows; and a display section that includes display elements interposed between a pair of substrates and includes n×m pixels, in which the display section includes a pixel electrode which is formed for each pixel, a counter electrode which faces the plurality of pixel electrodes through the display elements, a pixel switching element which is connected to the first control lines and the second control lines and switches a power supply application state for the pixel electrode, and a pixel memory circuit which is connected to the pixel switching element, in which the storage type display device further includes: a branched power supply line that supplies power to the pixel electrode in each row; a stem power supply line that supplies power to the branched power supply line which is commonly provided for the branched power supply line in each row; a pixel electrode switching circuit that switches a connection state between the branched power supply line and the pixel electrode according to content which is stored in the pixel memory circuit; a power supply line switching circuit that is connected between the stem power supply line and the branched power supply line, and that is configured to include a plurality of unit power supply line switching circuits which select connection states between the stem power supply line and the branched power supply line; and a control circuit that disconnects or connects the stem power supply line from or to the branched power supply line according to whether or not the content which is stored in the pixel memory circuit is rewritten, and in which the unit power supply line switching circuits are arranged on one end side and the other end side of the display section in a row direction, and one unit power supply line switching circuit is provided to the branched power supply line.

Therefore, as described above, the rewriting time is decreased and the electric power consumption is decreased.

In addition, since the unit power supply line switching circuits are arranged on one end side and the other end side of the display section in the row direction, the directions of the display irregularities in the row direction of the display section become reverse directions in the row which is arranged on one end side and the row which is arranged on the other end side, and thus the display irregularities of the display section in the row direction are cancelled out or reduced.

In the storage type display device according to the aspect of the invention, the unit power supply line switching circuits may be alternately arranged on one end side and the other end side of the display section in the row direction.

Therefore, the directions of the display irregularities in the row direction of the display section become the reverse directions for each row, and thus the display irregularities of the display section in the row direction are cancelled out or reduced.

In the storage type display device according to the aspect of the invention, the power supply line switching circuit may be connected between the stem power supply line and a branched power supply line in each row, and selects the connection state between the stem power supply line and the branched power supply line in each row, and the control circuit may disconnect or connect the stem power supply line from or to the branched power supply line in each row according to whether or not the content which is stored in the pixel memory circuit is rewritten.

Therefore, it is possible to individually control each of the pixels.

In the storage type display device according to the aspect of the invention, the power supply line switching circuit may be connected between the stem power supply line and the branched power supply line for each of a plurality of rows, and selects the connection state between the stem power supply line and the branched power supply line in each of the plurality of rows, and the control circuit may disconnect or connect the stem power supply line from or to the branched power supply line for each of the plurality of rows according to whether or not the content which is stored in the pixel memory circuit is rewritten.

Therefore, it is possible to simplify the configuration of the power supply line switching circuit, that is, it is possible to reduce the scale of the power supply line switching circuit. Therefore, the electric power consumption is reduced, and it is possible to reduce the dimensions of the frames (non-display areas) on the outer side of the display section.

According to still another aspect of the invention, there is provided a storage type display device including: first control lines that are provided in as many as n (n is an integer which is equal to or larger than 2) columns; second control lines that are provided in as many as m (m is an integer which is equal to or larger than 2) rows; and a display section that includes display elements interposed between a pair of substrates and includes n×m pixels, in which the display section includes a pixel electrode which is formed for each pixel, a counter electrode which faces the plurality of pixel electrodes through the display elements, a pixel switching element which is connected to the first control lines and the second control lines and switches a power supply application state for the pixel electrode, and a pixel memory circuit which is connected to the pixel switching element, in which the storage type display device further includes: a branched power supply line that supplies power to the pixel electrode in each row; a stem power supply line that supplies power to the branched power supply line which is commonly provided for the branched power supply line in each row; a pixel electrode switching circuit that switches a connection state between the branched power supply line and the pixel electrode according to content which is stored in the pixel memory circuit; a power supply line switching circuit that is connected between the stem power supply line and the branched power supply line for each of a plurality of rows, and respectively selects the connection state between the stem power supply line and the branched power supply line in each of the plurality of rows; and a control circuit that disconnects or connects the stem power supply line from or to the branched power supply line for each of the plurality of rows according to whether or not the content which is stored in the pixel memory circuit is rewritten.

Therefore, as described above, the rewriting time is decreased and the electric power consumption is decreased.

In addition, since the power supply line switching circuit is configured to select connection states of the stem power supply line and the branched power supply line for each of the plurality of rows, it is possible to simplify the configuration of the power supply line switching circuit, that is, it is possible to reduce the scale of the power supply line switching circuit. Therefore, the electric power consumption is reduced and it is possible to reduce the dimensions of the frames (non-display areas) on the outer side of the display section.

The storage type display device according to the aspect of the invention may further include: first power supply lines that are connected to high potential power supply terminals of the pixel memory circuit; second power supply lines that are connected to low potential power supply terminals of the pixel memory circuit; a first common power supply line to which the first power supply lines are connected; and a second common power supply line to which the second power supply lines are connected, in which at least any one of the first common power supply line and the second common power supply line are commonly used for two adjacent pixels in the row direction.

Therefore, it is possible to reduce the pixel pitch in the row direction, and thus it is possible to improve high definition and it is possible to simplify the configuration of the circuit.

The storage type display device according to the aspect of the invention may further include a connection circuit that causes the branched power supply line in a disconnection state for the stem power supply line to be connected to the power supply line which is connected to the common electrode.

Therefore, in the row in which the content of the pixel memory circuit is not rewritten, a voltage which is applied to a common electrode, is applied to the pixel electrode through the branched power supply line. Accordingly, the pixel electrode and the common electrode become the same potential, and display is not changed.

In the storage type display device according to the aspect of the invention, the pixel memory circuit may be a capacitor.

Therefore, the connection state of the branched power supply line and the pixel electrode is switched by the pixel electrode switching circuit according to the voltage which is accumulated in the capacitor.

In the storage type display device according to the aspect of the invention, the pixel memory circuit may include a latch circuit.

Therefore, the connection state of the branched power supply line and the pixel electrode is switched by the pixel electrode switching circuit according to the voltage which is written into the latch circuit.

In the storage type display device according to the aspect of the invention, the power supply line switching circuit may include a transfer gate.

Therefore, the voltage, which is applied to the stem power supply line, is securely supplied to the branched power supply line by the transfer gate in which connection resistance is low.

The storage type display device according to the aspect of the invention may further include: a power supply line memory circuit that is connected to the power supply line switching circuit, and is configured to determine a driving state of the power supply line switching circuit; and a reset circuit that resets content of the power supply line memory circuit.

Therefore, the power supply line switching circuit becomes the ON state or OFF state based on the content which is written into the power supply line memory circuit. That is, the connection state of the stem power supply line and the branched power supply line is determined by the content which is written into the power supply line memory circuit. In a case in which display is changed, the content of all the power supply line memory circuit is reset by the reset circuit to the initial settings. Accordingly, in the case of the initial settings, all of the stem power supply lines and the branched power supply lines become the disconnection state, and the row branched power supply line and the stem power supply line corresponding to the pixel memory circuits, in which content is rewritten, become the connection state according to the content which is written into the power supply line memory circuit.

The storage type display device according to the aspect of the invention may further include: a memory switching element that switches the connection state between a power supply line selection signal line, which is connected to the second control lines and supplies a voltage to be written into the power supply line memory circuit in a reset circuit, and the power supply line memory circuit; and a gate enabling circuit that disconnects the pixel switching element from the second control lines in a case in which the power supply line memory circuit and the power supply line selection signal line are in a connection state by the memory switching element.

Therefore, in a case in which the power supply line memory circuit is reset, a voltage, which causes the memory switching element to be the ON state, is supplied from the second control lines, with the result that the power supply line selection signal line and the power supply line memory circuit become the connection state, and thus the voltage, which is supplied to the power supply line selection signal line, is written into the power supply line memory circuit. In addition, in a case in which the power supply line selection signal line and the power supply line memory circuit become the connection state, the pixel switching element is disconnected from the second control lines by the gate enabling circuit. Accordingly, in a case in which the power supply line memory circuit is reset, the pixel switching element is not affected even though the voltage which is supplied to the second control lines is changed.

According to still another aspect of the invention, there is provided an electronic apparatus which includes the storage type display device according to the aspect of the invention.

Therefore, even in a case in which display is changed for only a partial row, the electronic apparatus reduces the rewriting time and electric power consumption is decreased. Meanwhile, the electronic apparatus includes a tablet, an electronic book, a smart phone, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a storage type display device and an electronic apparatus of the invention will be described in detail based on proper embodiments with reference to the accompanying drawings.

First Embodiment

Hereinafter, a first embodiment of the invention will be described.

Figure 1:
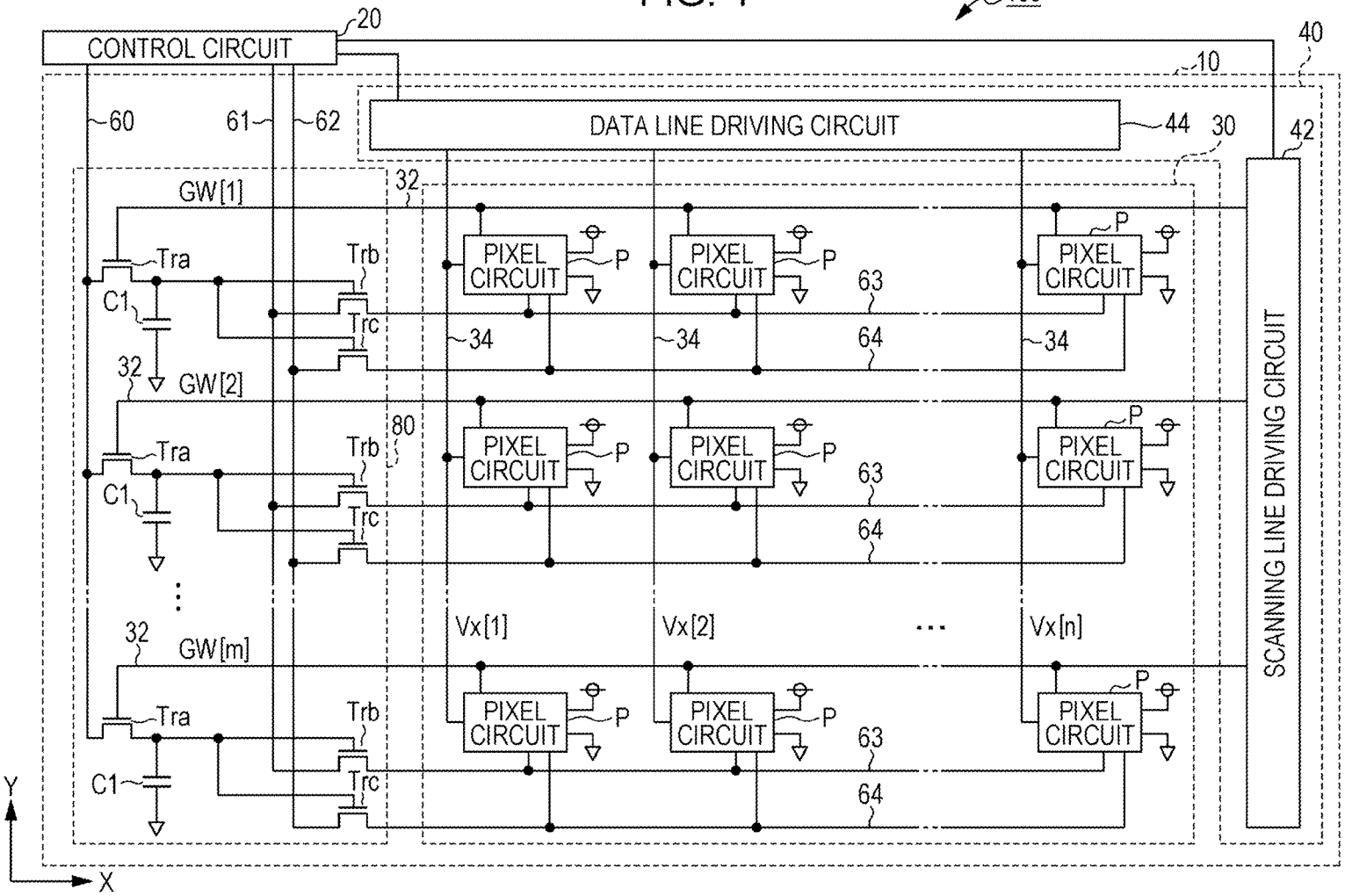
FIG. 1 is a block diagram illustrating the main configuration of a storage type display device according to a first embodiment of the invention.

FIG. 1 is a diagram illustrating the main configuration of a electrophoretic display device 100 as an example of a storage type display device according to the first embodiment of the invention.

Hereinafter, as illustrated in FIG. 1, two axes which are perpendicular to each other are referred to as an X axis and a Y axis (same as in other drawings) for convenience of explanation. In addition, a direction which is parallel to the X axis is referred to as an "X direction" or a "row direction", and a direction which is parallel to the Y axis is referred to as a "Y direction" or a "column direction". That is, the X direction is the same as the row direction, and the Y direction is the same as the column direction.

As illustrated in FIG. 1, the electrophoretic display device 100 includes an electrophoretic panel 10 and a control circuit 20.

The electrophoretic panel 10 includes a display section 30 in which a plurality of pixel circuits P are arranged, a driving section 40 which drives each of the pixel circuits P, and a branched power supply line selecting circuit 80. The driving section 40 includes a scanning line driving circuit 42 and a data line driving circuit 44.

The control circuit 20 integrally controls each of the sections of the electrophoretic panel 10 based on video signals and synchronization signals which are supplied from a host device.

The display section 30 is formed with m scanning lines 32 which extend in the X direction as examples of second control lines, and n data lines 34 which extend in the Y direction and cross the scanning lines 32 as examples of first control lines (m and n are integer which is equal to or greater than 2). The plurality of pixel circuits P are arranged at the intersections of the scanning lines 32 and the data lines 34, and are arranged in a matrix shape of vertical m rows and horizontal n columns.

Figure 2:
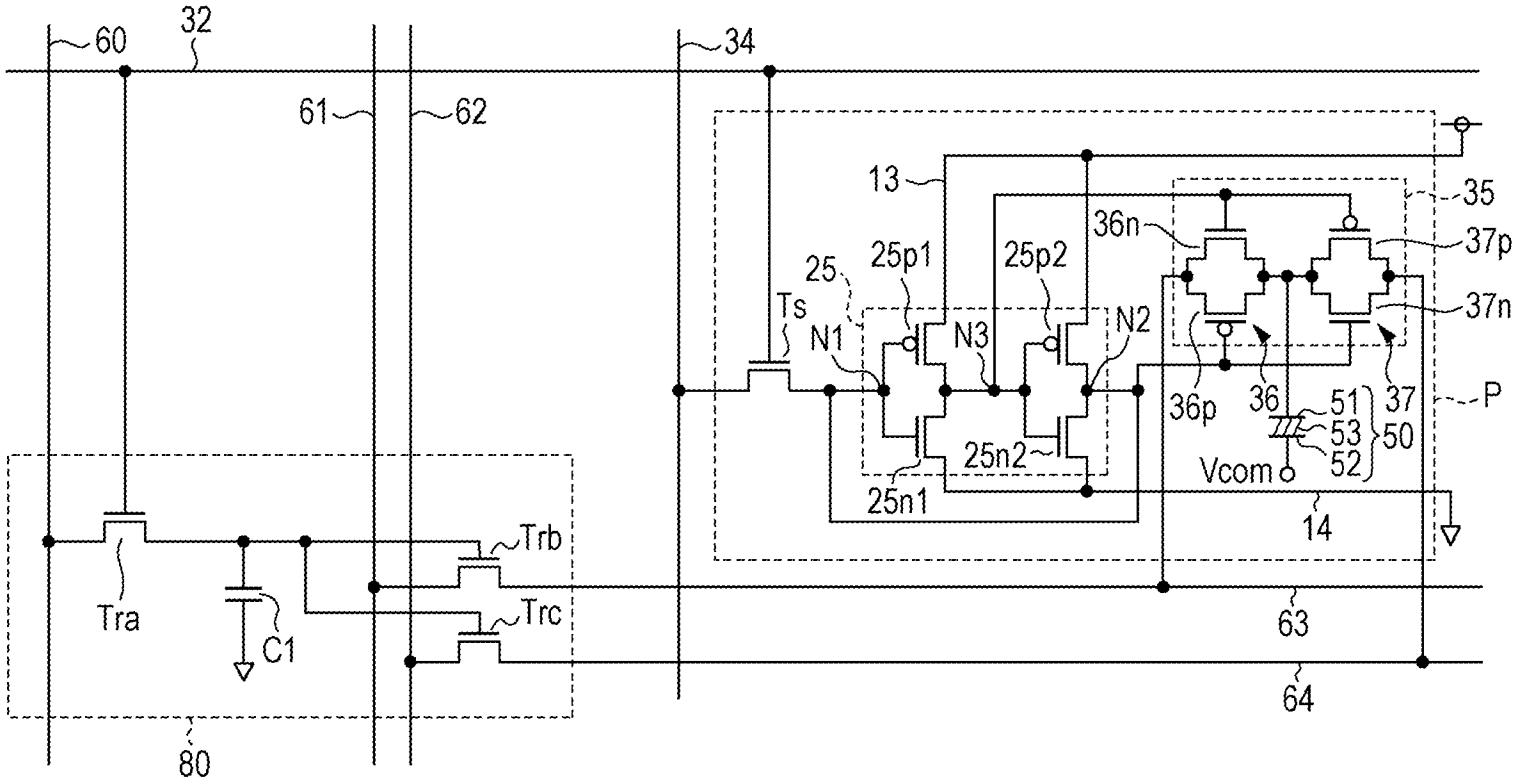
FIG. 2 is a diagram illustrating an example of the configuration of a pixel circuit.

FIG. 2 is a diagram illustrating an example of the configuration of a pixel circuit P. FIG. 2 illustrates only one pixel circuit (pixel) P which is located at the j-th column ($1 \leq j \leq n$) of an i-th row ($1 \leq i \leq m$). As illustrated in the drawing, the pixel circuit P includes an electrophoretic element 50, a selection switch Ts, a memory circuit 25, and a switching circuit 35.

The selection switch Ts, which is an example of a pixel switching element, includes a negative metal oxide semiconductor (N-MOS). In the selection switch Ts, the scanning line 32 is connected to a gate section, the data line 34 is connected to a source side, and the memory circuit 25 is connected to the drain side, respectively. The selection switch Ts is used to input a data signal, which is input from the data line driving circuit 44 through the data line 34, to the memory circuit 25 by connecting the data line 34 to the memory circuit 25 during a period in which a scanning signal is input from the scanning line driving circuit 42 through the scanning line 32.

The memory circuit 25, which is an example of a pixel memory circuit, is a latch circuit, and includes two positive metal oxide semiconductors (P-MOSs) **25*p*1 and 25*p*2, and two N-MOSs 25*n*1 and 25*n*2. A first power supply line 13 is connected to the source sides of the P-MOSs 25*p*1 and 25*p*2, and a second power supply line 14 is connected to the source sides of the N-MOSs 25*n*1 and 25*n*2. Therefore, the source sides of the P-MOS 25*p*1 and the P-MOS 25*p*2 are the high potential power supply terminals of the memory circuit 25, and the source sides of the N-MOS 25*n*1 and the N-MOS 25*n*2 are the low potential power supply terminals of the memory circuit 25**.

In addition, the switching circuit 35, which is an example of a pixel electrode switching circuit, includes a first transfer gate 36 and a second transfer gate 37. The first transfer gate 36 includes a P-MOS **36*p* and an N-MOS 36*n*. The second transfer gate 37 includes a P-MOS 37*p* and an N-MOS 37*n***.

The source side of the first transfer gate 36 is connected to a first branched power supply line 63, and the source side of the second transfer gate 37 is connected to a second branched power supply line 64. The drain sides of the transfer gates 36 and 37 are connected to a pixel electrode 51.

The memory circuit 25 includes an input terminal N1 which is connected to the drain side of the selection switch Ts, and a first output terminal N2 and a second output terminal N3 which are connected to the switching circuit 35.

The gate section of the P-MOS 25*p*1 and the gate section of the N-MOS 25*n*1 in the memory circuit 25 function as the input terminal N1 of the memory circuit 25. The input terminal N1 is connected to the drain side of the selection switch Ts and is connected to the first output terminal N2 (the drain side of the P-MOS 25*p*2 and the drain side of the N-MOS 25*n*2) of the memory circuit 25.

Further, the first output terminal N2 is connected to the gate section of the P-MOS 36*p* of the first transfer gate 36 and the gate section of the N-MOS 37*n* of the second transfer gate 37.

The gate section of the P-MOS 25*p*2 and the gate section of the N-MOS 25*n*2 in the memory circuit 25 function as the second output terminal N3 of the memory circuit 25.

The second output terminal N3 is connected to the drain side of the P-MOS 25*p*1 and the drain side of the N-MOS 25*n*1, and is connected to the gate section of the N-MOS 36*n* of the first transfer gate 36 and the gate section of the P-MOS 37*p* of the second transfer gate 37.

The memory circuit 25 is used to maintain a data signal, which is sent from the selection switch Ts, and to input the data signal to the switching circuit 35.

The switching circuit 35 functions as a selector which alternatively selects any one of the first and second branched power supply line 63 and 64 based on the data signal, which is input from the memory circuit 25, and connects the selected branched power supply line to the pixel electrode 51. At this time, only one of the first and second transfer gates 36 and 37 operates according to the level of the data signal.

Specifically, in a case in which a low level (L) is input to the input terminal N1 of the memory circuit 25 as the data signal, the low level (L) is output from the first output terminal N2. Therefore, in the transistors which are connected to the first output terminal N2 (input terminal N1), the P-MOS 36*p* operates and the N-MOS 36*n*, which is connected to the second output terminal N3, operates, and thus the transfer gate 36 is driven. Therefore, the first branched power supply line 63 is electrically connected to the pixel electrode 51.

In contrast, in a case in which a high level (H) is input to the input terminal N1 of the memory circuit 25 as the data signal, the high level (H) is output from the first output terminal N2. Therefore, in the transistors which are connected to the first output terminal N2 (input terminal N1), the N-MOS 37*n* operates and the P-MOS 37*p*, which is connected to the second output terminal N3, operates, and thus the transfer gate 37 is driven. Therefore, the second branched power supply line 64 is electrically connected to the pixel electrode 51.

Further, the first branched power supply line 63 or the second branched power supply line 64 is conducted to the pixel electrode 51 through the operated transfer gate, and a voltage is applied to the pixel electrode 51.

In addition, the memory circuit 25 can maintain the data signal, which is input through the selection switch Ts as described above, as the voltage, and can maintain the state of the switching circuit 35 without performing a refreshing operation for a fixed period of time. Therefore, it is possible to maintain the voltage of the pixel electrode 51 by the function of the memory circuit 25. In addition, since it is possible to provide a plurality of output terminals which output different signals, it is possible to perform appropriate control according to the configuration of the switching circuit 35.

Figure 3:
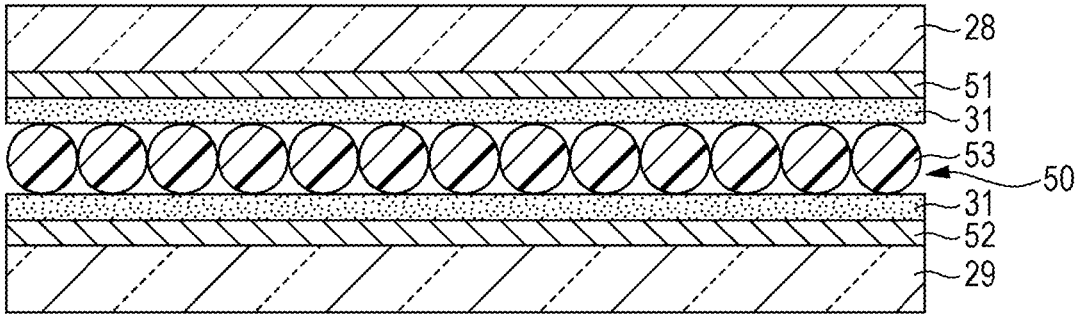
FIG. 3 is a sectional diagram illustrating a display section.

The electrophoretic element 50 includes a pixel electrode 51 and a common electrode 52 which face each other, and a plurality of microcapsules 53 which are arranged between the pixel electrode 51 and the common electrode 52, as illustrated in FIG. 3. In the embodiment, the side of the common electrode 52 corresponds to electrodes on the side of observation. Meanwhile, since the common electrode is an electrode which faces the plurality of pixel electrodes 51 through the display elements, the common electrode 52 is referred to as the counter electrode but will be described as the common electrode in the embodiment.

The electrophoretic element 50 as an example of a display element includes the plurality of microcapsules 53. The electrophoretic element 50 is fixed between the element substrate 28 and the counter substrate 29 using adhesive layers 31. That is, the adhesive layers 31 are formed between the electrophoretic element 50 and both the substrates 28 and 29.

Meanwhile, the adhesive layer 31 on the side of the element substrate 28 is essentially necessary for adhesion with the surface of the pixel electrode 51. However, the adhesive layer 31 on the side of the counter substrate 29 is not essentially necessary. The reason for this is that only the adhesive layer 31 on the side of the element substrate 28 is assumed as the essentially necessary adhesive layer 31 in a case in which the common electrode 52, the plurality of microcapsules 53 and the adhesive layer 31 on the side of the counter substrate 29 are manufactured on the counter substrate 29 through a coherent manufacturing process and then treated as an electrophoretic sheet.

The element substrate 28 is a substrate which is formed of, for example, glass or plastic. The pixel electrode 51 is formed on the element substrate 28, and the pixel electrode 51 is formed in a rectangular shape for each of the pixel circuits P. Although not shown in the drawing, the scanning line 32, the data line 34, the first branched power supply line 63, the second branched power supply line 64, the first power supply line 13, the second power supply line 14, the selection switch Ts, the memory circuit 25, the switching circuit 35 and the like, which are illustrated in FIGS. 1 and 2, are formed in areas between the respective pixel electrodes 51 or on the bottom surfaces (the layer on the side of the element substrate 28) of the pixel electrodes 51.

Since the counter substrate 29 corresponds to a side on which an image is displayed, the counter substrate 29 is, for example, a substrate, such as glass, which has translucency. A material, which has translucency and conductivity, is used for the common electrode 52 which is formed on the counter substrate 29. For example, MgAg (magnesium silver), ITO (indium tin oxide), in IZO (indium zinc oxide), and the like are used.

Meanwhile, generally, the electrophoretic element 50 is formed on the side of the counter substrate 29 in advance, and is treated as an electrophoretic sheet which includes up to the adhesive layer 31. In addition, a protective release paper sticks to the side of the adhesive layer 31.

In the manufacturing process, the display section 30 is formed by sticking the electrophoretic sheet, from which the release paper is peeled off, to the element substrate 28 in which the separately manufactured pixel electrode 51 or the circuit, is formed. Therefore, in a general configuration, the adhesive layer 31 is present on only the side of the pixel electrode 51.

Figure 4:
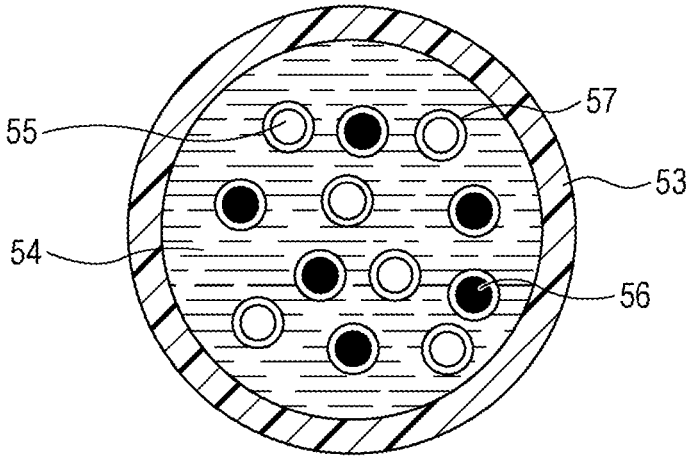
FIG. 4 is a configuration diagram illustrating microcapsules.

FIG. 4 is a configuration diagram illustrating the microcapsule 53. The microcapsule 53 has, for example, a grain size of approximately 50 μm and is formed of a transparent polymer resin such as an acrylate resin formed of polymethylmethacrylate, polyethyl methacrylate, or the like, a urea resin, gum arabic, or the like. The microcapsules 53 are interposed between the common electrode 52 and the above-described pixel electrode 51, and the plurality of microcapsules 53 are vertically and horizontally arranged in one pixel. Binders (not shown in the drawing), which fix the microcapsules 53, are provided to bury the vicinities of the microcapsules 53.

The microcapsule 53 is spherical, and enclosed with charged corpuscles, such as a dispersion medium 54 which is a solvent for disperse the electrophoretic particles, a plurality of white particles (electrophoretic particles) 55 as the electrophoretic particles, and a plurality of black particles (electrophoretic particles) 56, inside thereof. In the embodiment, the white particles are charged with plus, and the black particles are charged with minus. Meanwhile, the invention is not limited to such an aspect. The white particles may be charged with minus and the black particles may be charged with plus.

The dispersion medium 54 is liquid which disperses the white particles 55 and the black particles 56 in the microcapsule 53.

As the dispersion medium 54, it is possible to mix a surfactant with the single material or the mixture of, for example, alcohol system solvents such as water, methanol, ethanol, isopropanol, butanol, octanol and methyl cellosolve, various types of esters such as ethyl acetate and butyl acetate, ketones such as acetone, methyl ethyl ketone, and methyl isobutyl ketone, aliphatic hydrocarbon such as pentane, hexane and octane, alicyclic hydrocarbon such as cyclohexane and methylcyclohexane, aromatic hydrocarbon such as benzene and benzens which have a long chain alkyl group including toluene, xylene, hexyl benzene, heptyl benzene, octyl benzene, nonyl benzene, decyl benzene, undecyl benzene, dodecyl benzene, tridecyl benzene and tetradecyl benzene, halogenated hydrocarbon such as, methylene chloride, chloroform, carbon tetrachloride and 1,2-dichloroethane, carboxylate salt, or other various types of petroleum.

The white particles 55 are particles (polymer or colloid) which are formed of, for example, white pigments such as titanium dioxide, zinc oxide, or antimony trioxide, and, for example, are positively charged.

The black particles 56 are particles (polymer or colloid) which are formed of, for example, black pigments such as aniline black or carbon black, and, for example, are negatively charged.

Therefore, white particles 55 and the black particles 56 can be migrated by electric fields which are generated by the potential difference between the pixel electrode 51 and the common electrode 52 in the dispersion medium 54.

It is possible to add electrolyte, a surfactant, metallic soap, a resin, gum, oil, varnish, charge control agents, which include particles, such as compound, dispersing agents, such as titanium-coupling agents, aluminum-coupling agents, and silane-coupling agents, lubricant, stabilizing agents, and the like to the pigments as necessary.

The white particles 55 and the black particles 56 are covered by ions in the solvent, and ion layers 57 are formed on the surfaces of the particles. An electric double layer is formed between the white particles 55, the black particles 56, and the ion layer 57, which are charged. Generally, it has been known that, even in a case in which the charged corpuscles, such as the white particles 55 and the black particles 56, receive an electric field at a frequency of 10 kHz or higher, the charged corpuscles little respond to the electric field and little migrate. It has known that, since the ions, which are present in the vicinity of the charged corpuscles, have very small particle diameters compared to the charged corpuscles, the ions migrate according to an electric field in a case in which an electric field at a frequency of 10 kHz or higher is applied.

Figure 5:
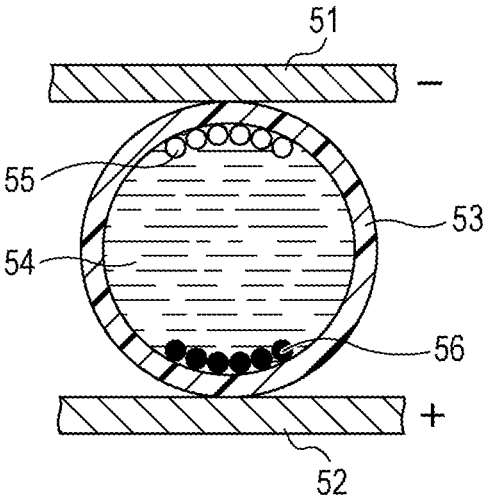
FIG. 5 is a diagram illustrating the operation of the microcapsules.
Figure 6:
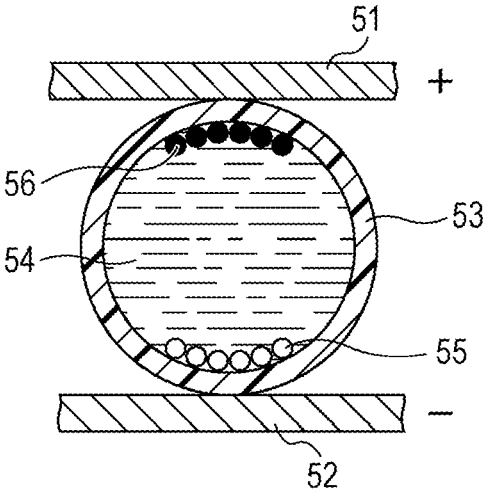
FIG. 6 is a diagram illustrating the operation of the microcapsules.

FIGS. 5 and 6 are diagrams illustrating the operation of the microcapsule 53. Here, an ideal case in which the ion layer 57 is not formed will be described as an example.

In a case in which the pixel electrode 51 is set to low potential and the common electrode 52 is set to high potential in the relationship between the pixel electrode 51 and the common electrode 52, the white particles 55, which are charged with plus, migrate to the side of the pixel electrode 51 in the microcapsule 53 by the electric field generated by the electrodes. In contrast, the black particles 56 which are charged with minus migrate to the side of the common electrode 52 in the microcapsule 53. Therefore, the black particles 56 accumulate on the side of the display surface (the side of the common electrode 52) in the microcapsule 53. In a case in which the pixel circuit P is viewed from the side of the common electrode 52, which is the observation side, "black" which is the color of the black particles 56 is recognized.

In contrast, in a case in which the pixel electrode 51 is set to high potential and the common electrode 52 is set to low potential in the relationship between the pixel electrode 51 and the common electrode 52, the black particles 56, which are charged with minus, migrate to the side of the pixel electrode 51 in the microcapsule 53 by the electric field generated by the electrodes. In contrast, the white particles 55 which are charged with plus migrate to the side of the common electrode 52 in the microcapsule 53. Therefore, the white particles 55 accumulate on the side of the display surface (the side of the common electrode 52) in the microcapsule 53. In a case in which the pixel circuit P is viewed from the side of the common electrode 52, which is the observation side, "white" which is the color of the white particles 55 is recognized.

As described above, it is possible to acquire desired gray scale display by setting the voltage between the pixel electrode 51 and the common electrode 52 to a value according to gray scale (brightness) which is desired to be displayed and causing the electrophoretic particles to migrate.

Meanwhile, in a case in which the application of a voltage between the pixel electrode 51 and the common electrode 52 stops, the electric field disappears, and thus the electrophoretic particles stops by the viscous resistance of the solvent. The electrophoretic particles can stop at a prescribed location for a long time due to the viscous resistance of the solvent, and thus the electrophoretic particles have a property (storage) in which a display state acquired in a case in which a prescribed voltage is applied is maintained after the application of the prescribed voltage stops.

Here, although description is performed using two types of particles, that is, white and black, one type of particles or three or more types of particles may be used. The colors of the particles are not limited to white and black, and the combination of arbitrary color particles may be used.

In addition, the invention is not limited to the configuration in which the particles and the dispersion medium are enclosed in the microcapsule. For example, a structure may be provided in which partition walls for division are formed of an epoxy resin or the like in a small space on the element substrate 28, the space is filled with the particles and the dispersion medium, and the counter substrate 29, on which the common electrode 52 is formed, is bonded to the apexes of the partition walls in the adhesive layer 31.

Description returns to FIG. 1.

The scanning line driving circuit 42 and the branched power supply line selecting circuit 80 are arranged on one end side and the other end side in the X direction (row direction) (right and left directions in FIG. 1) of the display section 30 through the display section 30. That is, the scanning line driving circuit 42 is arranged on the right side of the display section 30 in FIG. 1 and the branched power supply line selecting circuit 80 is arranged on the opposite side thereof, that is, on the left side of the display section 30 in FIG. 1. Therefore, it is possible to cause the dimensions of frames (non-display areas), which are located on right and left of the display section 30, to be almost equal. Meanwhile, in the configuration illustrated in the drawing, the scanning line driving circuit 42 is arranged on the right side and the branched power supply line selecting circuit 80 is arranged on the left side. However, the invention is not limited thereto. For example, the scanning line driving circuit 42 may be arranged on the left side and the branched power supply line selecting circuit 80 may be arranged on the right side. Otherwise, for example, the branched power supply line selecting circuit 80 may be arranged on one side of the display section 30 which is formed in a rectangular shape and the scanning line driving circuit 42 may be arranged on any one of three sides other than the one side. That is, the scanning line driving circuit 42 may be arranged on a predetermined end side of the display section 30, and the branched power supply line selecting circuit 80 may be arranged on an end side which is different from the predetermined end of the display section 30.

The scanning line driving circuit 42 outputs scanning signals (signals) GW[1] to GW[m] to the respective scanning lines 32. Here, a scanning signal, which is output to an i-th row scanning line 32, is expressed as GW[i]. In a case in which the scanning line driving circuit 42 sets the scanning signal GW[i] to an active level (high level) for only a prescribed period, the selection switches Ts of n pixel circuits P, which belong to the i-th row, are simultaneously changed to an ON state. The transition of the scanning signal GW[i] to the high level means the selection of the scanning line 32 at the i-th row. In addition, although the scanning line driving circuit 42 normally selects the scanning line 32 one by one and applies a high level voltage, the scanning line driving circuit 42 has a function of simultaneously selecting all of the scanning lines 32 and applying the high level voltage according to necessity. Further, the scanning line driving circuit 42 has a function of sequentially selecting only specified scanning lines 32 and applying the high level voltage.

The data line driving circuit 44 generates data signals (signals) Vx[1] to Vx[n] corresponding to one row (n) pixel circuits P which are selected by the scanning line driving circuit 42, and outputs the data signals to the respective data lines 34. Here, a data signal, which is output to the data line 34 in a j-th column, is expressed as Vx[j].

Here, a case in which a data signal Vx is supplied to the pixel circuit P which is located in the j-th column of the i-th row, is assumed. In this case, the data line driving circuit 44 is synchronized at timing in which the scanning line driving circuit 42 selects the scanning line 32 in the i-th row, and outputs a voltage signal, which has a size according to gray scale ("designated gray scale") designated to the pixel circuit P, to the data line 34 in a j-th column as a data signal Vx[j]. In addition, the data line driving circuit 44 has a function of setting all of the data lines 34 to high impedance as necessary.

The data signal Vx[j] is supplied to the input terminal N1 of the memory circuit 25 of the pixel circuit P through the selection switch Ts in the ON state (refer to FIG. 2), and the content of the memory circuit 25 is programmed to the designated gray scale. Therefore, the voltage between both the ends of the electrophoretic element 50 of the pixel circuit P (the voltage between the pixel electrode 51 and the common electrode 52) is set to a value according to the designated gray scale of the pixel circuit P.

As described above, the driving section 40 selects the scanning line 32 in the i-th row, and outputs the data signal Vx[j], which has the size according to the designated gray scale of the pixel circuit P located in the j-th column of the i-th row, to the data line 34 in the j-th column. The operation is referred to as an operation of writing the data signal Vx[j] to the pixel circuit P.

Figure 7:
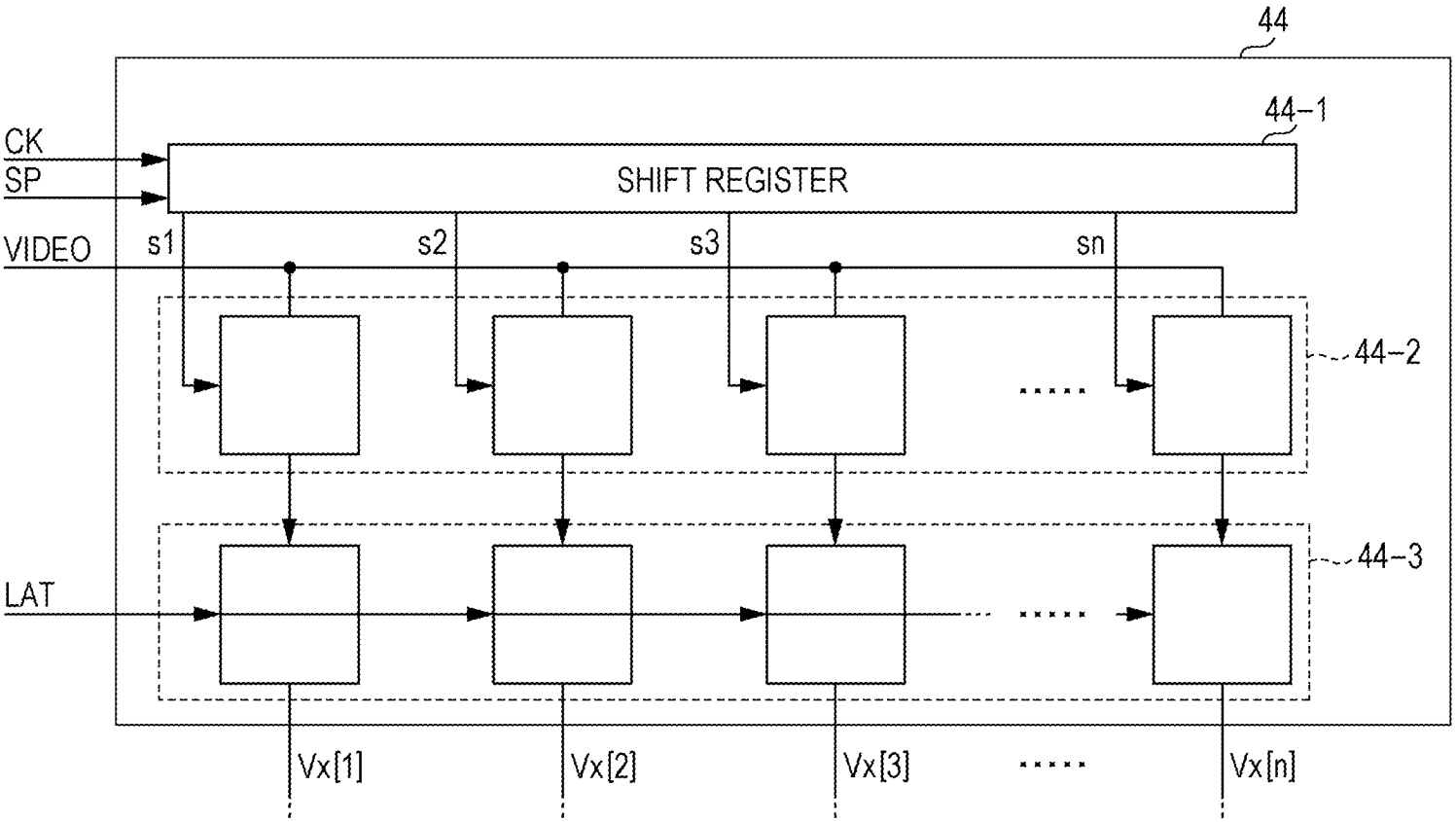
FIG. 7 is a diagram illustrating an example of the configuration of a data line driving circuit.

FIG. 7 is a diagram illustrating an example of the configuration of the data line driving circuit 44. As shown in the drawing, the data line driving circuit 44 includes a shift register 44-1, a first latch circuit 44-2, and a second latch circuit 44-3.

The shift register 44-1 shifts a start pulse SP according to a clock signal CK, which is supplied from the control circuit 20, and sequentially outputs sampling signals s1 to sn from a first stage corresponding to the data line 34 in a first column to an n-th stage corresponding to the data line 34 in an n-th column.

The first latch circuit 44-2 sequentially captures video signals VIDEO from a stage, to which the sampling signals s1 to sn are input, during periods corresponding to the sampling signals s1 to sn, and outputs the video signals to the second latch circuit 44-3. Meanwhile, video signals VIDEO are supplied from the control circuit 20 to the first latch circuit 44-2.

The second latch circuit 44-3 captures and maintains the video signal VIDEO (data signals Vx[1] to Vx[n]), which are supplied from the respective stages of the first latch circuit 44-2, at timing in which the latch pulses LAT is activated, and simultaneously supplies the data signals Vx[1] to Vx[n], which correspond to one row, to the data lines 34 which correspond to the first column to the n-th column.

Specifically, after, for example, data signals Vx[1] to Vx[n], which correspond to an i-th row, are captured from the video signal VIDEO to the first latch circuit 44-2 under the control of the control circuit 20, the latch pulse LAT is activated, and the data signals Vx[1] to Vx[n], which correspond to the i-th row, are simultaneously supplied to the data lines 34 corresponding to from the first column to the n-th column. The scanning line driving circuit 42 sets a scanning signal Gw[i] to an active level in synchronization with the supply of the data signal.

Therefore, the memory circuits 25 of all of the pixel circuits P on the i-th row are programmed to designated gray scale.

Hereinafter, the configuration and the operation of the branched power supply line selecting circuit 80 will be described.

As illustrated in FIG. 1, the branched power supply line selecting circuit 80 as an example of the power supply line switching circuit includes a selection switch Tra which has a gate section connected to each scanning line 32, a capacitor C1 which is connected to the drain side of each selection switch Tra, a first branched power supply line selection switch Trb which has a drain side connected to each first branched power supply line 63, and a second branched power supply line selection switch Trc which has a drain side connected to each second branched power supply line 64.

The selection switch Tra, which is an example of a memory switching element, includes an N-MOS. The selection switch Tra includes a gate section which is connected to the scanning line 32, a source side which is connected to the signal line 60 that is an example of the power supply line selection signal line, and a drain side which is connected to a capacitor C1 that is an example of a power supply line memory circuit, to a first branched power supply line selection switch Trb, and to the gate section of a second branched power supply line selection switch Trc, respectively. The selection switch Tra is used to set the voltage of the capacitor C1 to the voltage VSEL of the signal line 60 by connecting the signal line 60 to the capacitor C1.

The first branched power supply line selection switch Trb includes an N-MOS. The first branched power supply line selection switch Trb includes a gate section which is connected to the capacitor C1, a source side which is connected to a first stem power supply line 61, and a drain side which is connected to the source side of the first transfer gate 36, respectively. The first branched power supply line selection switch Trb is used to set the voltage of the pixel electrode 51 to the voltage VEPS0 of the first stem power supply line 61 through the first transfer gate 36 by connecting the first stem power supply line 61 to the first branched power supply line 63.

The second branched power supply line selection switch Trc includes an negative metal oxide semiconductor (N-MOS). The second branched power supply line selection switch Trc includes a gate section which is connected to the capacitor C1, a source side which is connected to a second stem power supply line 62, and a drain side which is connected to the source side of the second transfer gate 37, respectively. The second branched power supply line selection switch Trc is used to set the voltage of the pixel electrode 51 to the voltage VEPS1 of the second stem power supply line 62 through the second transfer gate 37 by connecting the second stem power supply line 62 to the second branched power supply line 64.

Figure 8:
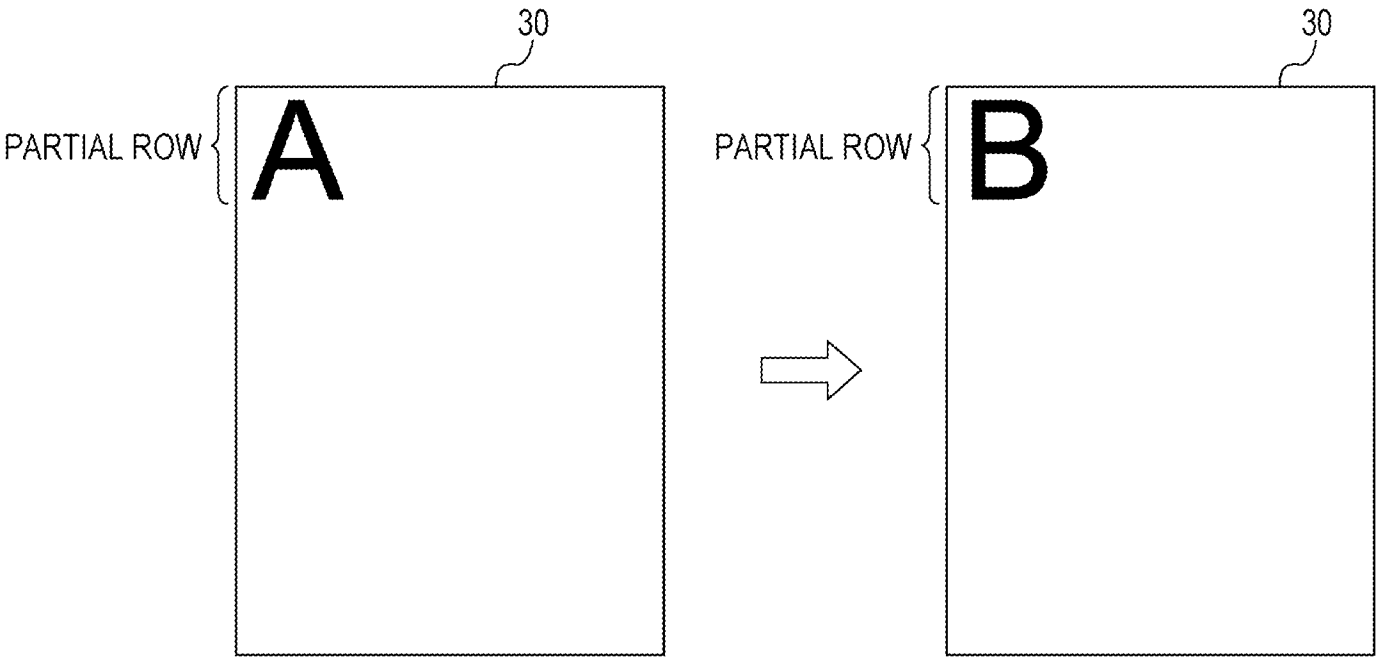
FIG. 8 is a diagram illustrating a partial row in which rewriting is performed.
Figure 9:
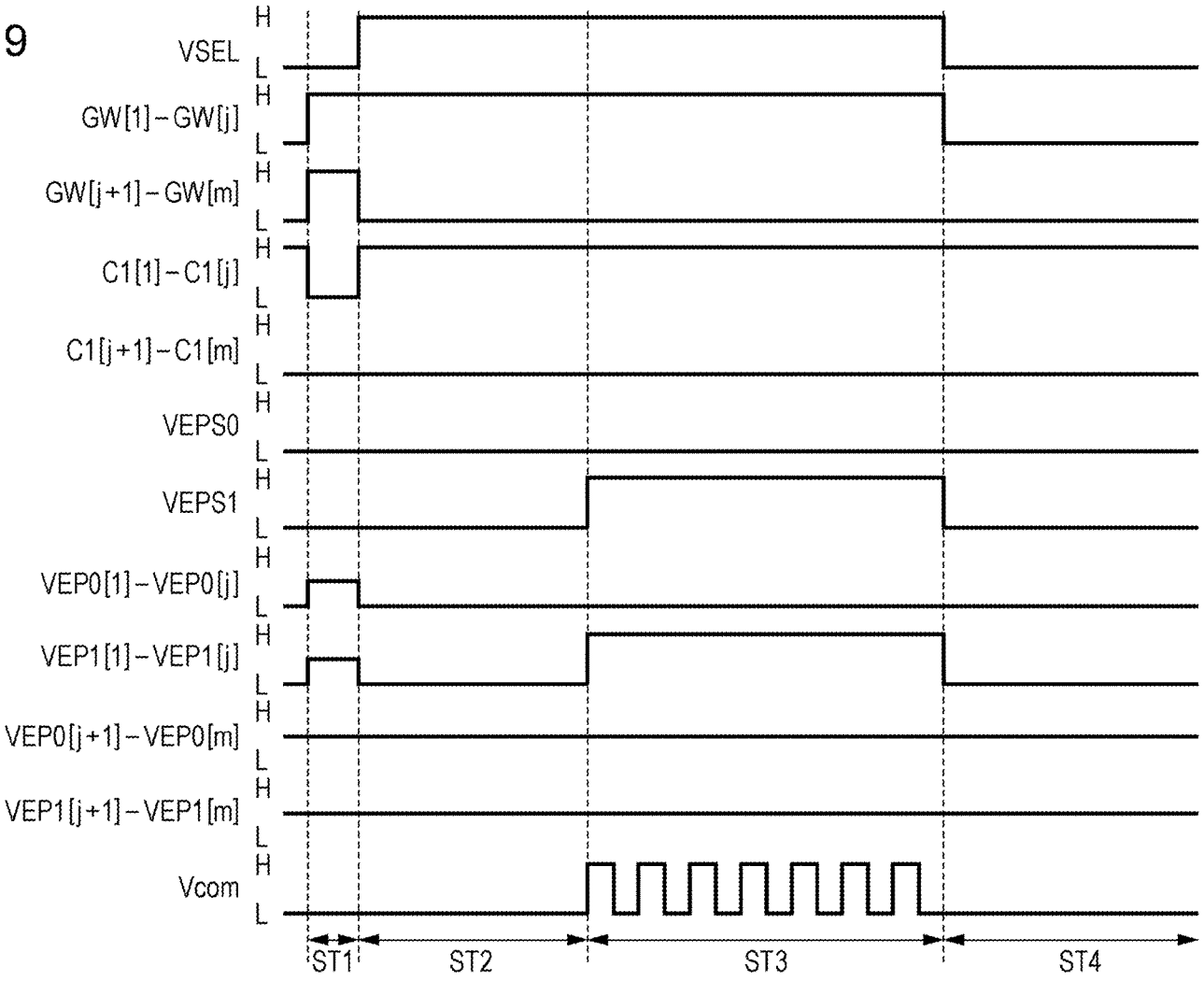
FIG. 9 is a timing chart pertaining to display of rewriting performed on the partial row.

Subsequently, a method of driving the electrophoretic display device 100 will be described with reference to the accompanying drawings. FIG. 9 is a timing chart illustrating the method of driving the electrophoretic display device 100. In the timing chart, an initial setting period, a programming period, a driving period, and a display maintaining period are included. Meanwhile, in the description below, as illustrated in FIG. 8, a case, in which an alphabet letter "A" is displayed in a partial row of the display section 30 (hereinafter, referred to as a partial row) and the display of the partial row is changed to an alphabet letter "B", will be described. That is, in the example, any type of display may be performed in rows other than the partial row and are not changed. Here, in the two voltages which are used in the embodiment, a low voltage is referred to as a voltage VL as reference (0 V), and a high voltage is referred to as a voltage VH.

Initial Setting Period

As illustrated in FIG. 9, in the initial setting period ST1, the control circuit 20 applies the voltage VL as the voltage VSEL of the signal line 60, and controls the scanning line driving circuit 42 to supply the voltage VH to all the scanning lines 32. As a result, all the selection switches Tra become the ON state, the voltage VSEL of the signal line 60, that is, the voltage VL is applied to all the capacitors C1, and thus the voltages of the capacitors C1 become the voltage VL. Meanwhile, in FIG. 9, the number and the letter in the parenthesis of C1[1] to C1[*m*] indicate a capacitor C1 connected to the scanning line 32 in a certain number of row. Therefore, for example, a description of C1[1] to C1[*m*] indicates from a capacitor C1, which is connected to the scanning line 32 in a first row, to a capacitor C1 which is connected to the scanning line 32 in an m-th row. In a case in which the voltages of the capacitors C1 in all the rows become the voltage VL, both the first branched power supply line selection switch Trb and the second branched power supply line selection switch Trc become an OFF state, the first stem power supply line 61 and the first branched power supply line 63 are electrically disconnected, and the second stem power supply line 62 and the second branched power supply line 64 are electrically disconnected. Meanwhile, the initial setting period ST1 is a very short period which is equal to or less than 1 msec.

Programming Period

In a case in which display is changed, it is necessary to rewrite the content of the memory circuit 25 as a pixel memory circuit. Here, the control circuit 20 determines whether or not to rewrite the content of the memory circuit 25, and specifies a row corresponding to the memory circuit 25, in which the content is rewritten, as the partial row. Further, in programming period ST2, the control circuit 20 applies a voltage VH as the voltage VSEL of the signal line 60, and controls the scanning line driving circuit 42 such that the high level voltage VH is sequentially supplied to only the scanning line 32 in the partial row one line at a time, as illustrated in FIG. 9. Meanwhile, in the example, description is performed while it is assumed that the first to j-th rows correspond to the partial row. That is, rows, in which the alphabet letters "A" and "B" illustrated in FIG. 8 are displayed, include first to j-th rows. In addition, the control circuit 20 controls the scanning line driving circuit 42 such that the voltage VL is supplied to rows other than the partial row, that is, the scanning lines 32 in a (j+1)-th row to an m-th row in the example. In addition, the control circuit 20 controls the data line driving circuit 44 such that the voltage VH is sequentially supplied to the scanning line 32 in the partial row one line at a time. In synchronization with this, data signals corresponding to an image, which is displayed in the respective pixel circuits P, are output to the data lines 34 corresponding to the respective pixel circuits P in the partial row. That is, the data line driving circuit 44 supplies data signals having the voltage VL to the data lines 34 corresponding to the pixel circuits P which display black in order to display the alphabet letter "B", and supplies data signals having the voltage VH to the data lines 34 corresponding to the pixel circuits P which display white in order to display the alphabet letter "B".

In a case in which the voltage VH is sequentially supplied to the scanning lines 32 in the partial rows from the first to j-th rows, the selection switches Ts in the image circuits P connected to the scanning lines 32 from the first to j-th rows become an ON state, and the voltages of the data lines 34 connected to the selection switches Ts are written into the memory circuits 25 which are connected to the selection switches Ts. That is, in the image circuit P which displays black, the data signal having the voltage VL is written into the memory circuit 25. In the image circuit P which displays white, the data signal having the voltage VH is written into the memory circuit 25.

As a result, in a case in which the data signal having the voltage VL is written into the memory circuit 25, the first transfer gate 36 of the transfer gates, which are connected to the memory circuit 25, becomes the ON state, and the second transfer gate 37 becomes the OFF state. Therefore, the first branched power supply line 63 and the pixel electrode 51 become the conduction state through the first transfer gate 36. In addition, in a case in which the voltage VH is written into the memory circuit 25, the second transfer gate 37 of the transfer gates, which are connected to the memory circuit 25, becomes the ON state, and the first transfer gate 36 becomes the OFF state. Therefore, the second branched power supply line 64 and the pixel electrode 51 become the conduction state through the second transfer gate 37.

In addition, the control circuit 20 connects the first stem power supply line to the second stem power supply line and connects the first branched power supply line to the first branched power supply line in the partial row, and disconnects the first stem power supply line from the second stem power supply line and disconnects the first branched power supply line from the first branched power supply line in rows other than the partial row. That is, in a case in which the voltage VH is supplied to the scanning line 32 in the partial row, the selection switch Tra, which is connected to the scanning line 32, becomes the ON state, the voltage VSEL of the signal line 60, which is connected to the selection switch Tra, that is, the voltage VH is applied to the capacitor C1 which is connected to the selection switch Tra. As a result, the voltage of the capacitor C1 is the voltage VH. In the example, voltages of the capacitors C1[1] to C1[*j*] are the voltage VH. Therefore, both the first branched power supply line selection switch Trb and the second branched power supply line selection switch Trc, which are connected to the capacitors C1[1] to C1[*j*], become the ON state, the first stem power supply line 61 is electrically connected to the first branched power supply line 63, and the second stem power supply line 62 is electrically connected to the second branched power supply line 64. As above, the first branched power supply line 63 and the second branched power supply line 64, which correspond to the partial row, are electrically connected to the first stem power supply line 61 and the second stem power supply line 62, respectively.

In contrast, the voltage VL is supplied to the scanning lines 32 other than the scanning line in the partial row, and thus the selection switch Tra, which is connected to the scanning line 32, becomes the OFF state and the voltage of the capacitor C1, which is connected to the selection switch Tra, maintains the voltage VL. In the example, the voltages of the capacitors C1[*j*+1] to C1[*m*] maintain the voltage VL. Therefore, both the first branched power supply line selection switch Trb and the second branched power supply line selection switch Trc, which are connected to the capacitors C1[*j*+1] to C1[*m*], become the OFF state. Therefore, the first stem power supply line 61 is electrically disconnected to the first branched power supply line 63, and the second stem power supply line 62 is electrically disconnected to the second branched power supply line 64. As above, the first branched power supply line 63 and the second branched power supply line 64, which correspond to rows other than the partial row, are electrically disconnected to the first stem power supply line 61 and the second stem power supply line 62, respectively.

Driving Period

Subsequently, as illustrated in FIG. 9, in the driving period ST3, the control circuit 20 applies the voltage VL as the voltage VEPS0 of the first stem power supply line 61, and applies a voltage VEPH as the voltage VEPS1 of the second stem power supply line 62. Here, the voltage VEPH is a voltage which is lower than the voltage VH. The reason for this is that the gate voltage of the branched power supply line selection switches Trb and Trc is lowered as much as the threshold voltage of the branched power supply line selection switches Trb and Trc such that the branched power supply line selection switches Trb and Trc become the ON state. As a result, the first branched power supply line 63 and the second branched power supply line 64, which correspond to the partial rows, are electrically connected to the first stem power supply line 61 and the second stem power supply line 62, respectively. Therefore, the voltages VEP0[1] to VEP0[*j*] of the first branched power supply line 63 in the first to j-th rows become the voltage VL, and the voltages VEP1[1] to VEP1[*j*] of the second branched power supply line 64 become the voltage VEPH. Meanwhile, the number and the letter in the parenthesis, acquired in a case in which the voltage is described as the voltages VEP0[1] to VEP0[*j*] and the voltages VEP1[1] to VEP1[*j*], indicate the voltage of the first branched power supply line 63 and the second branched power supply line 64 in a certain number of row. As described above, in the pixel circuit P which displays black, the voltage VEP0 of the first branched power supply line 63 is applied to the pixel electrode 51 through the first transfer gate 36, and thus the voltage VL is applied to the pixel electrode 51. In addition, in the pixel circuit P which displays white, the voltage VEP1 of the second branched power supply line 64 is applied to the pixel electrode 51 through the second transfer gate 37, and thus the voltage VEPH is applied to the pixel electrode 51.

In addition, in the driving period ST3, a pulse-shaped signal, in which the voltage VL and the voltage VEPH are repeated at prescribed cycles as illustrated in FIG. 9, is input to the common electrode 52 of each of the pixel circuits P by the control circuit 20. In the specification, such a driving method is referred to as a "common swing driving" method. In addition, the common swing driving method is defined as a driving method of applying a pulse-shaped signal, in which the voltage VEPH and the voltage VL are repeated, to the common electrode 52 for at least one or more cycles during the driving period. According to the common swing driving method, it is possible to securely cause desired electrodes to migrate using the black particles and the white particles, and thus it is possible to increase contrast. That is, in the pixel circuit P which displays black, the voltage VL is applied to the pixel electrode 51. Therefore, during a period in which the voltage Vcom of the common electrode 52 is the voltage VL, the potential difference does not occur between the pixel electrode 51 and the common electrode 52, and thus the black particles 56 and the white particles 55 of the electrophoretic element 50 do not migrate. However, during a period in which the voltage Vcom of the common electrode 52 is the voltage VEPH, the large potential difference occurs between the pixel electrode 51 and the common electrode 52, and thus the negatively-charged black particles 56 of the electrophoretic element 50 migrate to the side of the common electrode 52 and the positively-charged white particles 55 migrate to the side of the pixel electrode 51. As a result, black is displayed in the display the pixel circuit P.

Further, in the pixel circuit P which displays white, the voltage VEPH is applied to the pixel electrode 51. Therefore, during the period in which the voltage Vcom of the common electrode 52 is the voltage VEPH, the potential difference does not occur between the pixel electrode 51 and the common electrode 52, and thus the black particles 56 and the white particles 55 of the electrophoretic element 50 do not migrate. However, during the period in which the voltage Vcom of the common electrode 52 is the voltage VL, the large potential difference occurs between the pixel electrode 51 and the common electrode 52, and thus the negatively-charged black particles 56 of the electrophoretic element 50 migrate to the side of the pixel electrode 51 and the positively-charged white particles 55 migrate to the side of the common electrode 52. As a result, white is displayed in the display the pixel circuit P.

In contrast, the first branched power supply line 63 and the second branched power supply line 64, which correspond to the rows other than the partial row, are electrically disconnected from the first stem power supply line 61 and the second stem power supply line 62, respectively. Therefore, a high-impedance state occurs, and thus the pixel electrode 51, which is in the conductive state with any one of the first branched power supply line 63 and the second branched power supply line 64, becomes the high-impedance state, and thus an electric field is not generated between the pixel electrode 51 and the common electrode 52, and the black particles 56 and the white particles 55 of the electrophoretic element 50 do not migrate. Therefore, the display in the rows other than the partial row is not changed.

Display Maintaining Period

Subsequently, as illustrated in FIG. 9, in the display maintaining period ST4, the control circuit 20 sets all of the voltage Vcom of the common electrode 52, the voltage VEP0 of the first branched power supply line 63, and the voltage VEP1 of the second branched power supply line 64 to the voltage VL until subsequent display content is rewritten. Therefore, in the display maintaining period ST4, the voltage VL is commonly applied to the pixel electrodes 51 and the common electrodes 52 of the pixel circuits P corresponding to the partial row, and thus the potential difference does not occur. In this case, the display of the partial row is maintained by the maintain performance of the electrophoretic element 50. The first branched power supply line 63 and the second branched power supply line 64, which correspond to the rows other than the partial row, are electrically disconnected from the first stem power supply line 61 and the second stem power supply line 62, respectively, and thus the display is not changed in the display maintaining period ST4.

As described above, in the invention, the connection state of the first branched power supply line 63 and the second branched power supply line 64 with the pixel electrode 51 is switched by the switching circuit 35 as a pixel electrode switching circuit according to the content which is stored in the memory circuit 25 as a pixel memory circuit. In addition, the connection states of the first stem power supply line 61 and the second stem power supply line with the first branched power supply line 63 and the second branched power supply line 64 for each row are selected by the branched power supply line selecting circuit 80 as a power supply line switching circuit, respectively. Further, the branched power supply line selecting circuit 80 as the power supply line switching circuit is controlled by the control circuit 20. That is, the control circuit 20 disconnects or connects the first stem power supply line 61 and the second stem power supply line 62 from or to the first branched power supply line 63 and the second branched power supply line 64 for each row based on whether or not the content, which is stored in the memory circuit 25 as the pixel memory circuit, is rewritten. Specifically, in the partial row where the content, which is stored in the memory circuit 25 as the pixel memory circuit, is rewritten, the selection switch Tra becomes the ON state, with the result that the first stem power supply line 61 and the second stem power supply line 62 are connected to the first branched power supply line 63 and the second branched power supply line 64, and thus display is changed according to the data signal in the partial row. As a result, the display of the alphabet letter "A" in the display section 30 is changed to the display of the alphabet letter "B". However, in the rows other than the partial row where the content stored in the memory circuit 25 as the pixel memory circuit is not rewritten, the selection switch Tra becomes the OFF state, the first stem power supply line 61 and the second stem power supply line 62 are disconnected from the first branched power supply line 63 and the second branched power supply line 64, with the result that the voltage is not applied to the pixel circuits P in the rows, and thus the display is not changed.

Comparative Example

Figure 30:
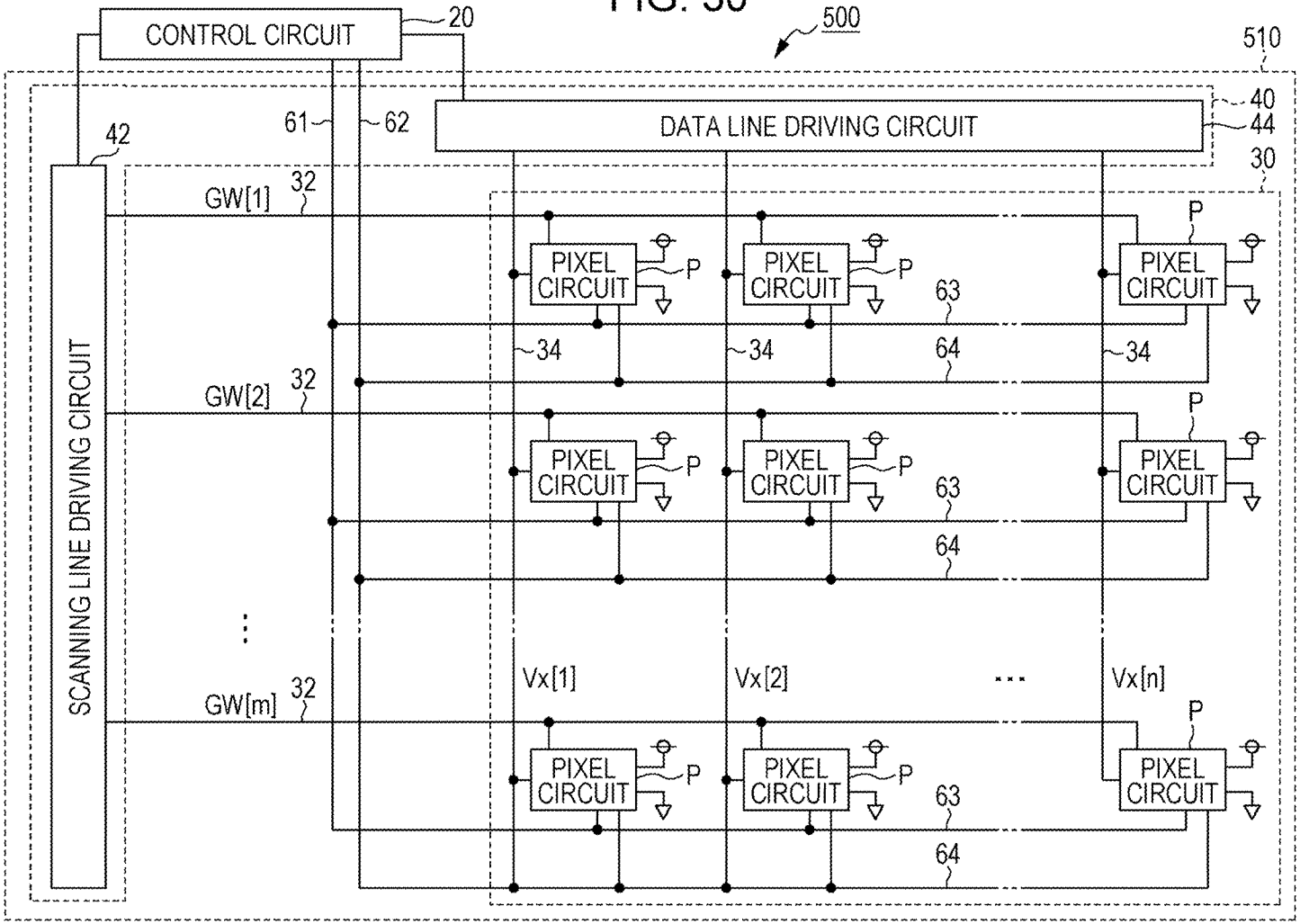
FIG. 30 is a block diagram illustrating the main configuration of a storage type display device according to a comparative example.

Subsequently, a comparative example, which is compared with the embodiment of the invention, will be described. The comparative example in FIG. 30 illustrates the main configuration of an electrophoretic display device 500 according to the related art. As illustrated in the drawing, the electrophoretic display device 500 includes an electrophoretic panel 510 and a control circuit 20. The configuration of the electrophoretic panel 510 is approximately the same as the configuration of the electrophoretic panel 10 according to the first embodiment. However, the electrophoretic panel 510 is not provided with the branched power supply line selecting circuit 80. That is, in the electrophoretic panel 510, the first stem power supply line 61 and the first branched power supply line 63 are normally electrically connected to the second stem power supply line 62 and the second branched power supply line 64.

Figure 31:
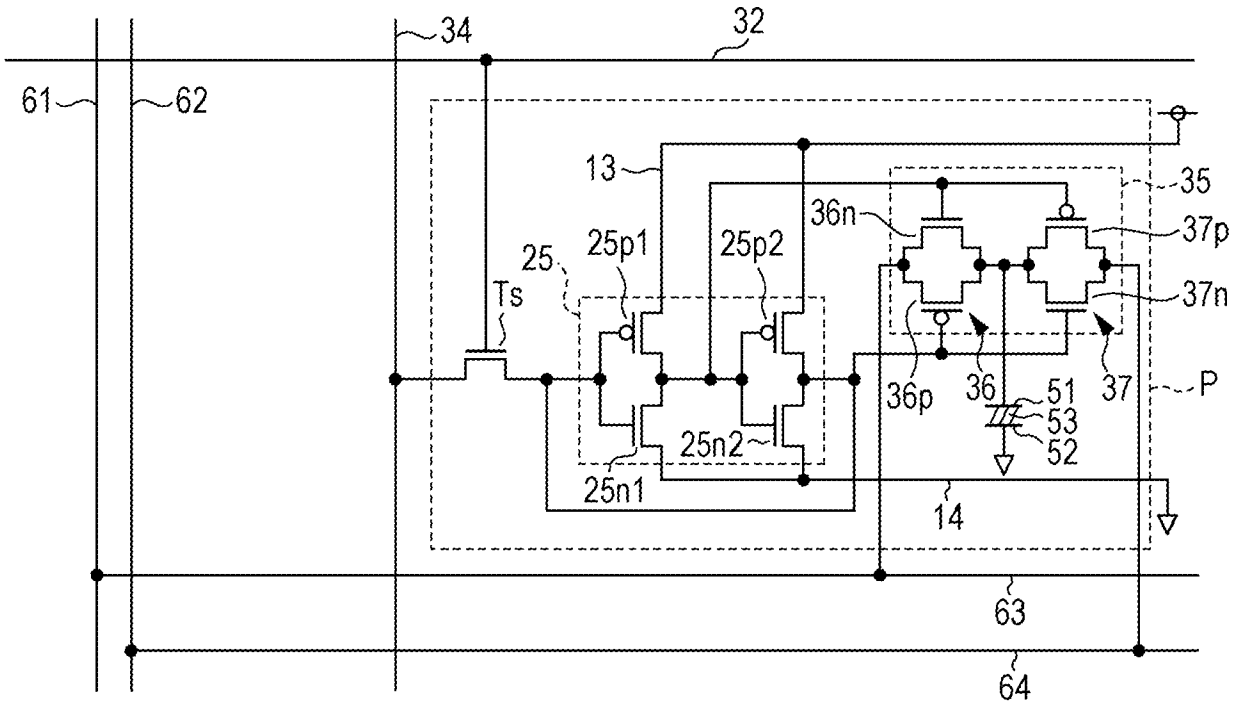
FIG. 31 is a diagram illustrating an example of the configuration of a pixel circuit according to the comparative example.

FIG. 31 is a diagram illustrating an example of the configuration of a pixel circuit P according to the comparative example. As illustrated in FIG. 31, the configuration of the pixel circuit P according to the comparative example is the same as the configuration of the pixel circuit P according to the first embodiment, and the same reference numerals are used for components which are common to the pixel circuit P according to the first embodiment illustrated in FIG. 2.

In the comparative example, the first stem power supply line 61 and the first branched power supply line 63 are normally electrically connected to the second stem power supply line 62 and the second branched power supply line 64. Therefore, in a case in which the voltage VEPS0 of the first stem power supply line 61 is set to the voltage VL, and the voltage VEPS1 of the second stem power supply line 62 is set to the voltage VEPH in order to rewrite only the partial row, not only the voltage VEP0 of the first branched power supply line 63 and the voltage VEP1 of the second branched power supply line 64 in the partial row but also the voltage VEP0 of the first branched power supply line 63 and the voltage VEP1 of the second branched power supply line 64 in rows other than the partial row are set to the voltage VEPS0 of the first stem power supply line 61 and the voltage VEPS1 of the second stem power supply line 62, respectively. As a result, unlike the above-described embodiment of the invention, the voltage is applied to the pixel electrodes 51 of the pixel circuits P in not only the partial row but also the rows other than the partial row during the driving period. Therefore, in the comparative example, it is necessary to set the data signal to be written into the memory circuit 25, the voltage VEP0 of the first branched power supply line 63, the voltage VEP1 of the second branched power supply line 64, and the voltage Vcom of the common electrode 52 such that display is not changed in the rows other than the partial row.

In order not to change the display in the rows other than the partial row, it is considered that, in the programming period, a data signal, which is the same as the data signal used for current display, is written into the memory circuits 25 of the pixel circuit P in the rows other than the partial row, and that, in the driving period, the current display is maintained through the common swing driving as the same as in the above-described embodiment. However, in the process, electric power consumption increases, and control becomes complicated. Here, in the comparative example, a driving method is used in which, in a case in which the display of the alphabet "A" is changed to the display of the alphabet "B", the same voltage is applied to the pixel electrodes 51 and the common electrodes 52 in the pixel circuits P, which are continuously displaying white in the partial row, and the pixel circuits P in the rows other than the partial row, with the result that the black particles and the white particles in the electrophoretic element 50 do not migrate, and thus display is not changed. Therefore, in the comparative example, the pixel circuits P which display white in the partial row are not directly changed to display black, and the display of the partial row, in which the alphabet letter "A" is displayed, is caused to be the display of white at once. Further, in a case in which the alphabet letter "B" is displayed, potential difference is generated between the pixel electrodes 51 and the common electrodes 52 of the pixel circuits P which display black. In a case in which the alphabet "A" is changed to the alphabet "B", the same voltage is applied to the pixel electrodes 51 and the common electrodes 52 in the pixel circuits P which maintain the display of white and the pixel circuits P in the rows other than the partial row, with the result that the black particles and the white particles in the electrophoretic element 50 do not migrate, and thus display is not changed.

Figure 32:
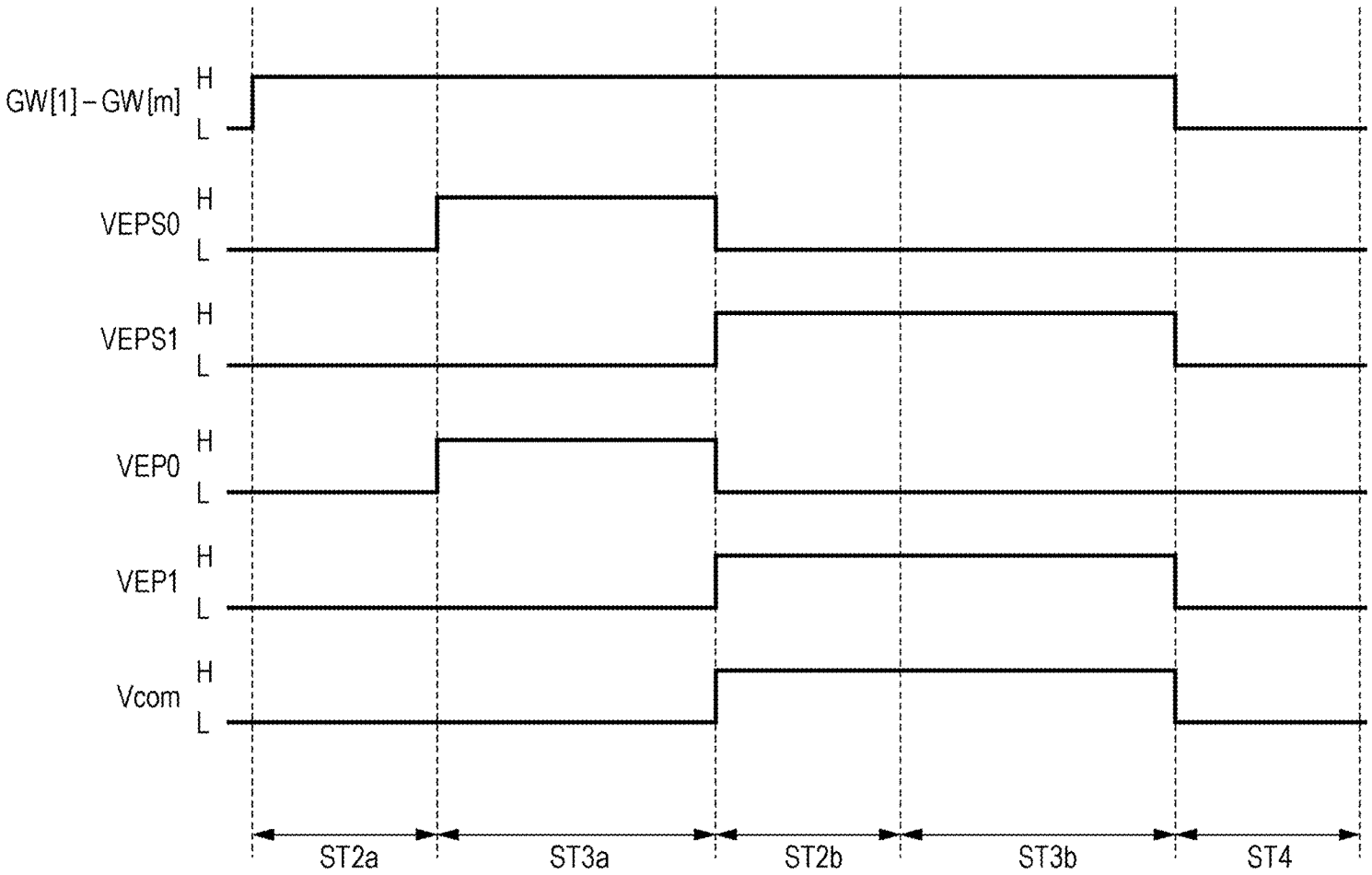
FIG. 32 is a timing chart illustrating the display of rewriting performed on a partial row according to the comparative example.

Hereinafter, a method of driving the electrophoretic display device 500 according to the comparative example will be described in detail with reference to the drawings. FIG. 32 is a timing chart illustrating the method of driving the electrophoretic display device 500. In the timing chart, a first programming period, a first driving period, a second programming period, a second driving period, and a display maintaining period are included. Hereinafter, similarly to the above-described embodiment of the invention, the driving method will be described for the case in which the alphabet letter "A" is displayed in the partial row of the display section 30 and the display in the partial row is changed to the alphabet letter "B". In the comparative example, the display in the rows other than the partial row is not changed.

First Programming Period

In a state in which the alphabet letter "A" is displayed in the partial row, in the first programming period, the memory circuits 25 of the pixel circuits P which display black of the alphabet "A" in the whole partial row are programmed with the voltage VL, and the memory circuits 25 of the pixel circuits P for colors other than black of the alphabet "A" and the pixel circuits P in rows other than the partial row are programmed with the voltage VH.

First Driving Period

As illustrated in FIG. 32, in a first driving period ST3*a*, the control circuit 20 applies a voltage VEPH as the voltage VEPS0 to the first stem power supply line 61, and applies the voltage VL as the voltage VEPS1 of the second stem power supply line 62. In addition, the control circuit 20 applies the voltage VL as the voltage Vcom to the common electrode 52. As a result, the voltage VEPH is applied to the pixel electrodes 51 of the pixel circuits P which display black. Therefore, the negatively-charged black particles 56 of the electrophoretic element 50 migrate to the side of the pixel electrode 51, and the positively-charged white particles 55 migrate to the side of the common electrode 52. As a result, in the pixel circuit P, display is changed from black to white.

In contrast, the voltage VL is applied to the pixel electrodes 51 of the pixel circuit P which displays white and the pixel circuits P in rows other than the partial row. Therefore, the potential of the pixel electrode 51 is the same as the potential of the common electrode 52, with the result that the black particles 56 and the white particles 55 of the electrophoretic element 50 do not migrate, and thus display is not changed. In a case in which the above-described driving is performed, all the display in the partial row becomes the display of white, and thus the display in the rows other than the partial row is not changed.

Second Programming Period

In the second programming period ST2*b*, the memory circuits 25 of the pixel circuits P which display black of the alphabet "B" in the partial row are programmed with the voltage VL, and the memory circuits 25 of the pixel circuits P for colors other than black of the alphabet "B" and all the pixel circuits P in rows other than the partial row are programmed with the voltage VH.

Second Driving Period

As illustrated in FIG. 32, in a second driving period ST3*b*, the control circuit 20 applies the voltage VL as the voltage VEPS0 to the first stem power supply line 61, and applies the voltage VEPH as the voltage VEPS1 of the second stem power supply line 62. In addition, the control circuit 20 applies the voltage VEPH as the voltage Vcom to the common electrode 52. As a result, the voltage VL is applied to the pixel electrode 51 of the pixel circuit P in a location corresponding to black. Therefore, the positively-charged white particles 55 of the electrophoretic element 50 migrate to the side of the pixel electrode 51, and the negatively-charged black particles 56 migrate to the side of the common electrode 52. As a result, in the pixel circuit P, display is changed from white to black.

In contrast, the voltage VEPH is applied to the pixel electrodes 51 of the pixel circuit P in a location corresponding to white and the pixel circuits P in rows other than the partial row. Therefore, the potential of the pixel electrode 51 is the same as the potential of the common electrode 52, with the result that the black particles 56 and the white particles 55 of the electrophoretic element 50 do not migrate, and thus display is not changed. In a case in which the above-described driving is performed, all the display in the partial row is changed from a white state to a state in which the alphabet letter "B" is displayed, and thus the display in the rows other than the partial row is not changed. In this manner, rewriting is performed on the display in only the partial row.

As it is apparent in a case in which the comparative example is compared with the first embodiment of the invention, in the comparative example, in a case in which rewriting is performed on the display in the partial row, the first stem power supply line 61 and the first branched power supply line 63, and the second stem power supply line 62 and the second branched power supply line 64 are normally electrically connected in all the rows, it is necessary to perform programming and driving control on all the pixel circuits P. As a result, a process, in which the display of the pixel circuits P which continuously display white and the pixel circuits P in the rows other than the partial row are not changed while displaying the entire partial row by white at once, is necessary, and thus two programming periods and two driving periods are necessary. In contrast, in the first embodiment of the invention, in a case in which the display of the partial row is rewritten, the first branched power supply line 63 and the second branched power supply line 64 in the rows other than the partial row are electrically disconnected from the first stem power supply line 61 and the second stem power supply line 62, respectively. Therefore, it is possible to directly rewrite the current display using subsequent display in the partial row without affecting the display in the rows other than the partial row, and thus one programming period and one driving period are necessary. In the first embodiment, the initial setting period is necessary. However, since the initial setting period is an extremely short period, and thus there is no problem. Therefore, according to the invention, it is possible to drastically reduce the time which is necessary to rewrite the display of the partial row. As a result, in the invention, it is possible to drastically decrease the electric power consumption.

Second Embodiment

Figure 10:
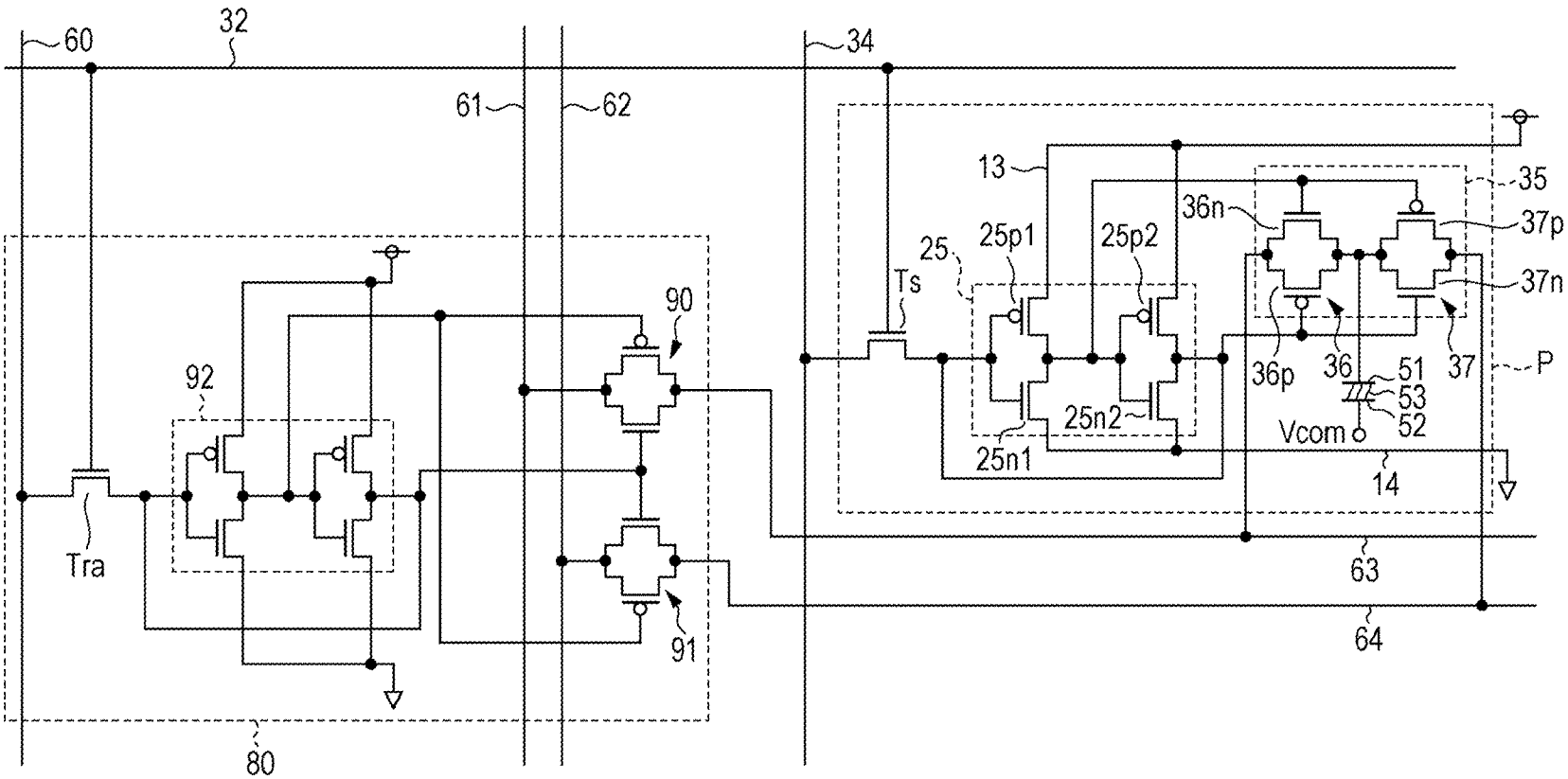
FIG. 10 is a diagram illustrating an example of the configuration of a pixel circuit according to a second embodiment.

FIG. 10 is a diagram illustrating the configuration of the pixel circuit P and the branched power supply line selecting circuit 80, which correspond to one row, in an electrophoretic display device according to a second embodiment.

Hereinafter, the second embodiment will be described. Meanwhile, description will be performed centering on difference from the above-described embodiment and the description of the same matters will not be repeated.

As illustrated in FIG. 10, the branched power supply line selecting circuit 80 as an example of the power supply line switching circuit may include transfer gates 90 and 91, a memory circuit 92 as an example of the power supply line memory circuit, and a selection switch Tra as an example of a memory switching element. In the example, the memory circuit 92 is provided instead of the capacitor C1, and the transfer gates 90 and 91 are used instead of the first branched power supply line selection switch Trb and the second branched power supply line selection switch Trc. In the circuit, in a case in which the voltage VSEL of a signal line 60 is a voltage VH, the voltage VH is written into the memory circuit 92, the transfer gates 90 and 91 become the ON state, and a first branched power supply line 63 and a second branched power supply line 64 are connected to a first stem power supply line 61 and a second stem power supply line 62. However, in a case in which the voltage VSEL of the signal line 60 is a voltage VL, the voltage VL is written into the memory circuit 92, the transfer gates 90 and 91 become the OFF state, and the first branched power supply line 63 and the second branched power supply line 64 are disconnected from the first stem power supply line 61 and the second stem power supply line 62.

In the case of such a configuration, it is possible to connect the first stem power supply line 61 and the second stem power supply line 62 to the first branched power supply line 63 and the second branched power supply line 64 in only the partial row in which rewriting is performed, and it is possible to disconnect the first stem power supply line 61 and the second stem power supply line 62 from the first branched power supply line 63 and the second branched power supply line 64 in rows other than the partial row.

With such a configuration, it is possible to raise the upper limit of a voltage VEH, which is supplied to the first stem power supply line 61 and the second stem power supply line 62, up to the voltage VH. If so, it is possible to increase the electric field intensity between the pixel electrode 51 and the common electrode 52, thereby enabling further high-speed rewriting to be performed.

In a case in which the way of viewing is changed, it is possible to cause the voltage VH to be a low voltage, and thus low power consumption is achieved.

In addition, it is possible to exhibit the same effect as in the above-described first embodiment in the embodiment.

Third Embodiment

Figure 11:
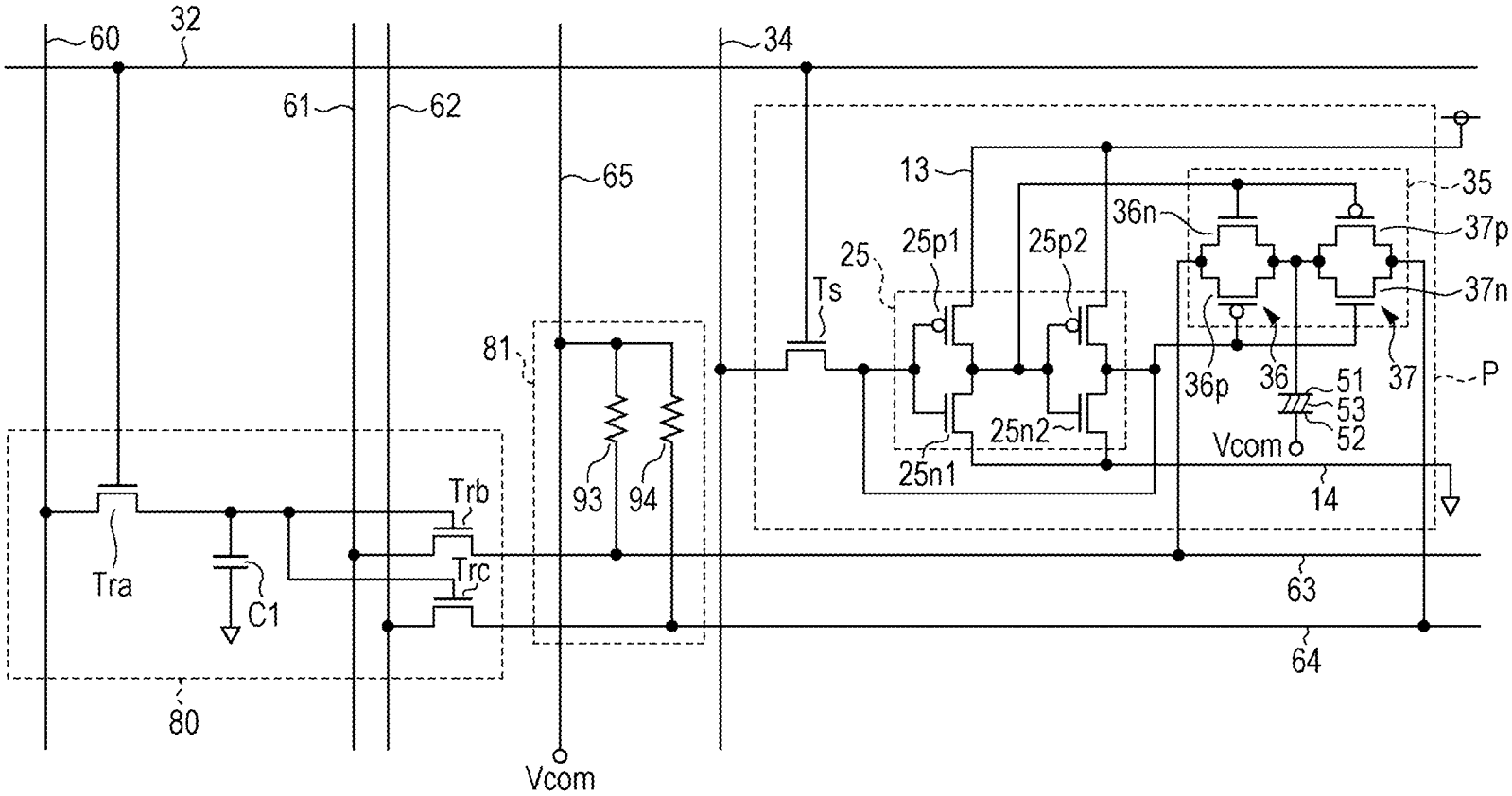
FIG. 11 is a diagram illustrating an example of the configuration of a pixel circuit according to a third embodiment.

FIG. 11 is a diagram illustrating the configuration of each pixel circuit P and the branched power supply line selecting circuit 80, which correspond to one row, in an electrophoretic display device according to a third embodiment.

Hereinafter, the third embodiment will be described. Meanwhile, description will be performed centering on difference from the above-described embodiment and the description of the same matters will not be repeated.

In the first embodiment, the first branched power supply line 63 and the second branched power supply line 64 in the rows other than the partial row are disconnected from the first stem power supply line 61 and the second stem power supply line 62. In the configuration, it is conceivable that some sort of voltage is applied to the pixel electrodes 51 of the pixel circuits P in the rows other than the partial row due to leak current or the like, and thus the display colors of pixels are changed.

Here, in the embodiment, at the same time that the first branched power supply line 63 and the second branched power supply line 64 in the rows other than the partial row are disconnected from the first stem power supply line 61 and the second stem power supply line 62, a branched power supply line connection circuit 81 is provided as an example of a connection circuit which is connected to the power supply line 65 of the common electrode 52.

For example, as illustrated in FIG. 11, the branched power supply line connection circuit 81 includes resistors 93 and 94, and is connected to the power supply line 65 of the common electrode 52. With such a configuration, the first branched power supply line 63 and the second branched power supply line 64 in the rows other than the partial row are disconnected from the first stem power supply line 61 and the second stem power supply line 62, and are connected to the power supply line 65 of the common electrode 52 through the resistors 93 and 94 by the branched power supply line connection circuit 81. Therefore, the potential of the pixel electrode 51 is the same as the potential of the common electrode 52, and the display in the rows other than the partial row is not changed.

Figure 12:
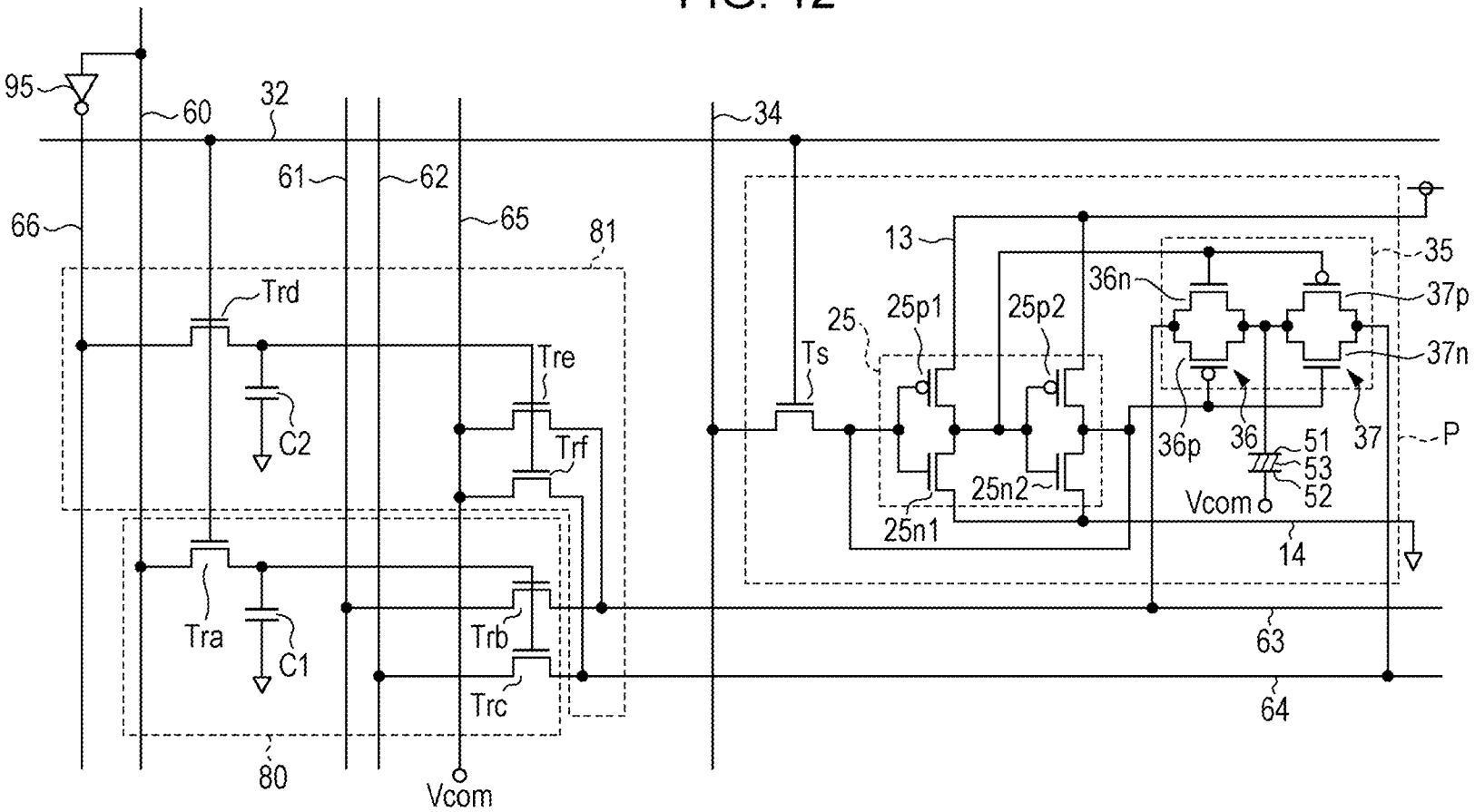
FIG. 12 is a diagram illustrating an example of the configuration of the pixel circuit according to the third embodiment.

In the circuit configuration illustrated in FIG. 11, current consumption increases. Therefore, the branched power supply line connection circuit 81 may be configured as illustrated in FIG. 12. In the example illustrated in FIG. 12, the branched power supply line connection circuit 81 includes a selection switch Trd, a first branched power supply line connection switch Tre, and a second branched power supply line connection switch Trf. In addition, in the example, a signal line 66, to which a voltage that causes the voltage VSEL of the signal line 60 to be inverted is applied by an inverter 95, is included.

The selection switch Trd includes an N-MOS. The selection switch Trd includes a gate section which is connected to a scanning line 32, a source side which is connected to the signal line 66, and a drain side which is connected to a capacitor C2 and the gate sections of the selection switches Tre and Trf. The selection switch Trd is used to set the voltage of the capacitor C2 to the voltage of the signal line 66, that is, the voltage VSEL of the signal line 60 to the inverted voltage by connecting the signal line 66 to the capacitor C2.

The selection switches Tre and Trf includes an N-MOS. The selection switches Tre and Trf include gate sections which are connected to the capacitor C2, source sides which are connected to the power supply line 65 of the common electrode 52, and drain sides which are respectively connected to the first branched power supply line 63 and the second branched power supply line 64. The selection switches Tre and Trf are used to connect the first branched power supply line 63 and the second branched power supply line 64 to the power supply line 65 of the common electrode 52 in a case in which the first branched power supply line 63 and the second branched power supply line 64 are disconnected from the first stem power supply line 61 and the second stem power supply line 62. With such a configuration, the first branched power supply line 63 and the second branched power supply line 64 in the rows other than the partial row are disconnected from the first stem power supply line 61 and the second stem power supply line 62, and are connected to the power supply line 65 of the common electrode 52 by the branched power supply line connection circuit 81. Therefore, the potential of the pixel electrode 51 is the same as the potential of the common electrode 52, and display is not changed in the rows other than the partial row.

Figure 13:
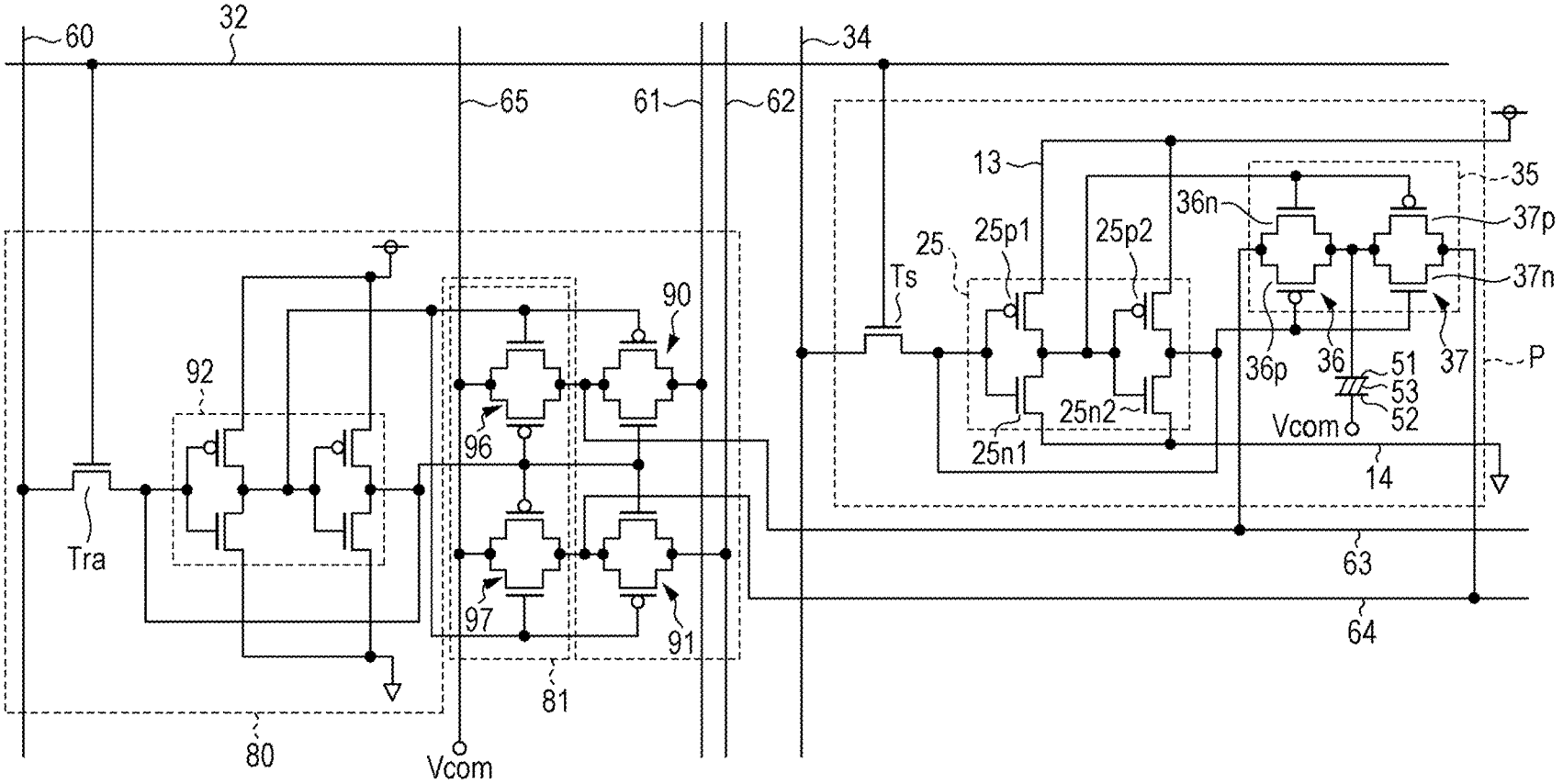
FIG. 13 is a diagram illustrating an example of the configuration of the pixel circuit according to the third embodiment.

In addition, in a case in which the branched power supply line selecting circuit 80 includes the transfer gates 90 and 91, the memory circuit 92, and the selection switch Tra as in the second embodiment, the branched power supply line connection circuit 81 may include transfer gates 96 and 97 as illustrated in FIG. 13. In the circuit, in a case in which the voltage VSEL of the signal line 60 is the voltage VH, the voltage VH is written into the memory circuit 92, the transfer gates 90 and 91 become the ON state, and the first branched power supply line 63 and the second branched power supply line 64 are connected to the first stem power supply line 61 and the second stem power supply line 62. However, in a case in which the voltage VSEL of the signal line 60 is the voltage VL, the voltage VL is written into the memory circuit 92, the transfer gates 90 and 91 becomes the OFF state, and the first branched power supply line 63 and the second branched power supply line 64 are disconnected from the first stem power supply line 61 and the second stem power supply line 62. However, in a case in which the voltage VL is written into the memory circuit 92, the transfer gates 96 and 97 become the ON state, the first branched power supply line 63 and the second branched power supply line 64 are connected to the power supply line 65 of the common electrode 52. Therefore, the potential of the pixel electrode 51 is the potential of the common electrode 52, and thus display is not changed in the rows other than the partial row.

As described above, according to the embodiment, in a case in which the first branched power supply line 63 and the second branched power supply line 64 in the rows other than the partial row are disconnected from the first stem power supply line 61 and the second stem power supply line 62, the first stem power supply line 61 and the second stem power supply line 62 is connected to the power supply line 65 of the common electrode 52 by the branched power supply line connection circuit 81. Therefore, the potential of the pixel electrode 51 is the same as the potential of the common electrode 52, and thus it is possible to securely prevent the display in the rows other than the partial row from being changed.

In addition, it is possible to exhibit the same effect as in the above-described first embodiment in the embodiment.

MODIFICATION EXAMPLE

Hereinafter, modification examples will be described. Meanwhile, description will be performed centering on difference from the above-described embodiment and the description of the same matters will not be repeated.

Modification Example 1

In the above-described first embodiment, the voltage VSEL of the signal line 60 is set to the voltage VL during the initial setting period, all the scanning lines 32 are selected by the scanning line driving circuit 42, and the capacitor C1 in each row is reset to the voltage VL. At this time, the selection switches Ts in all the pixel circuits become the ON state, the input/output terminals of the memory circuits 25 of all the pixel circuits P in the same column are electrically connected to the source side of the selection switch Ts, and thus there is a case in which unnecessary consumption current occurs depending on the content of each of the memory circuits 25.

Figure 14:
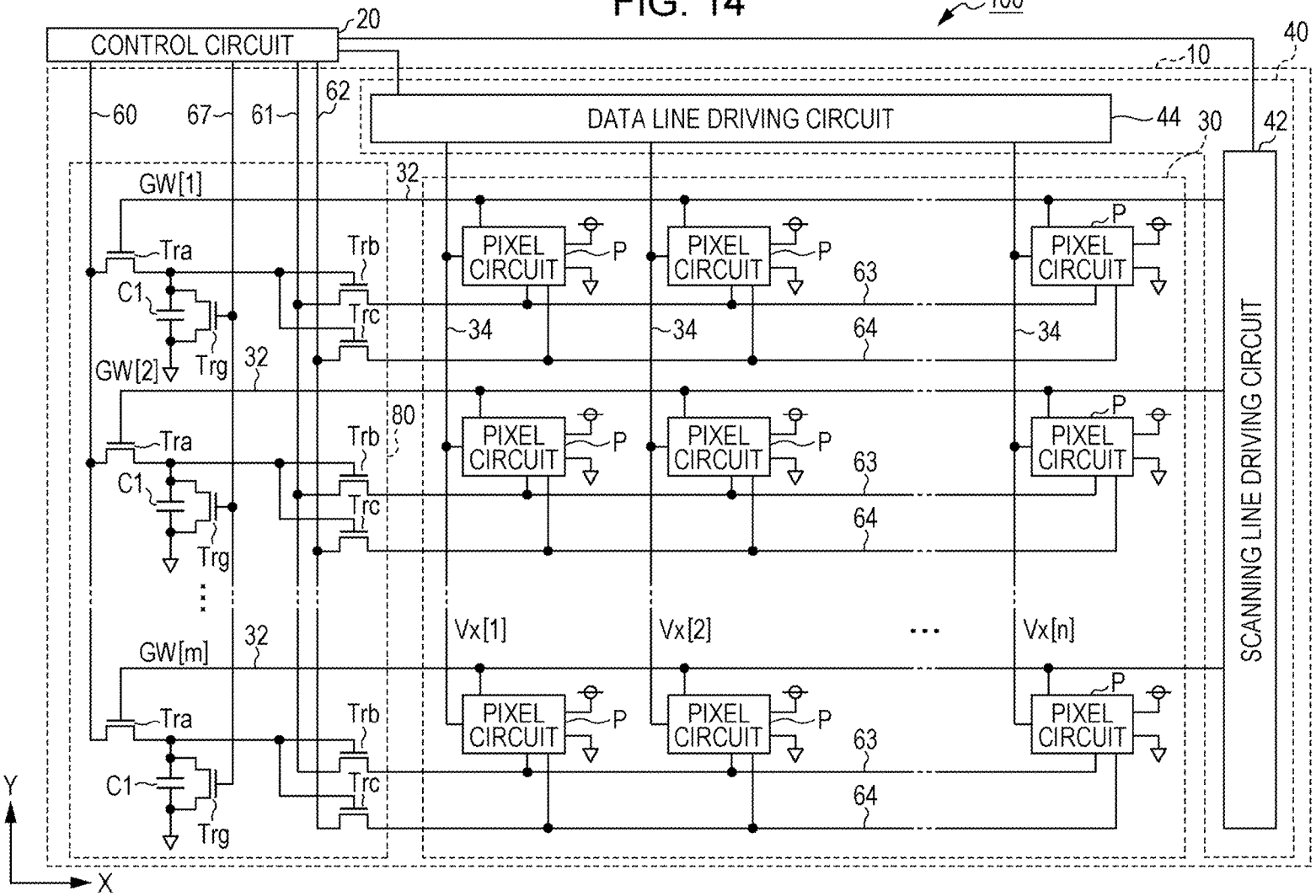
FIG. 14 is a block diagram illustrating the main configuration of a storage type display device according to a modification example.

In order to avoid this, the capacitors C1 in all the rows may be reset to the voltage VL in a circuit configuration as illustrated in FIG. 14. That is, both the ends of the capacitor C1 may be connected to the source and the drain of the selection switch Trg, and a reset signal of the voltage VH may be input to the gate of the selection switch Trg from the reset signal line 67. In this manner, it is possible to rest the capacitor C1 in a state in which all the scanning lines 32 are not selected in the scanning line driving circuit 42. Meanwhile, the voltage VSEL of the signal line 60 may be arbitrary. Meanwhile, a reset circuit using the selection switch Trg may be provided in the circuit according to the third embodiment illustrated in FIGS. 11 and 12.

Figure 15:
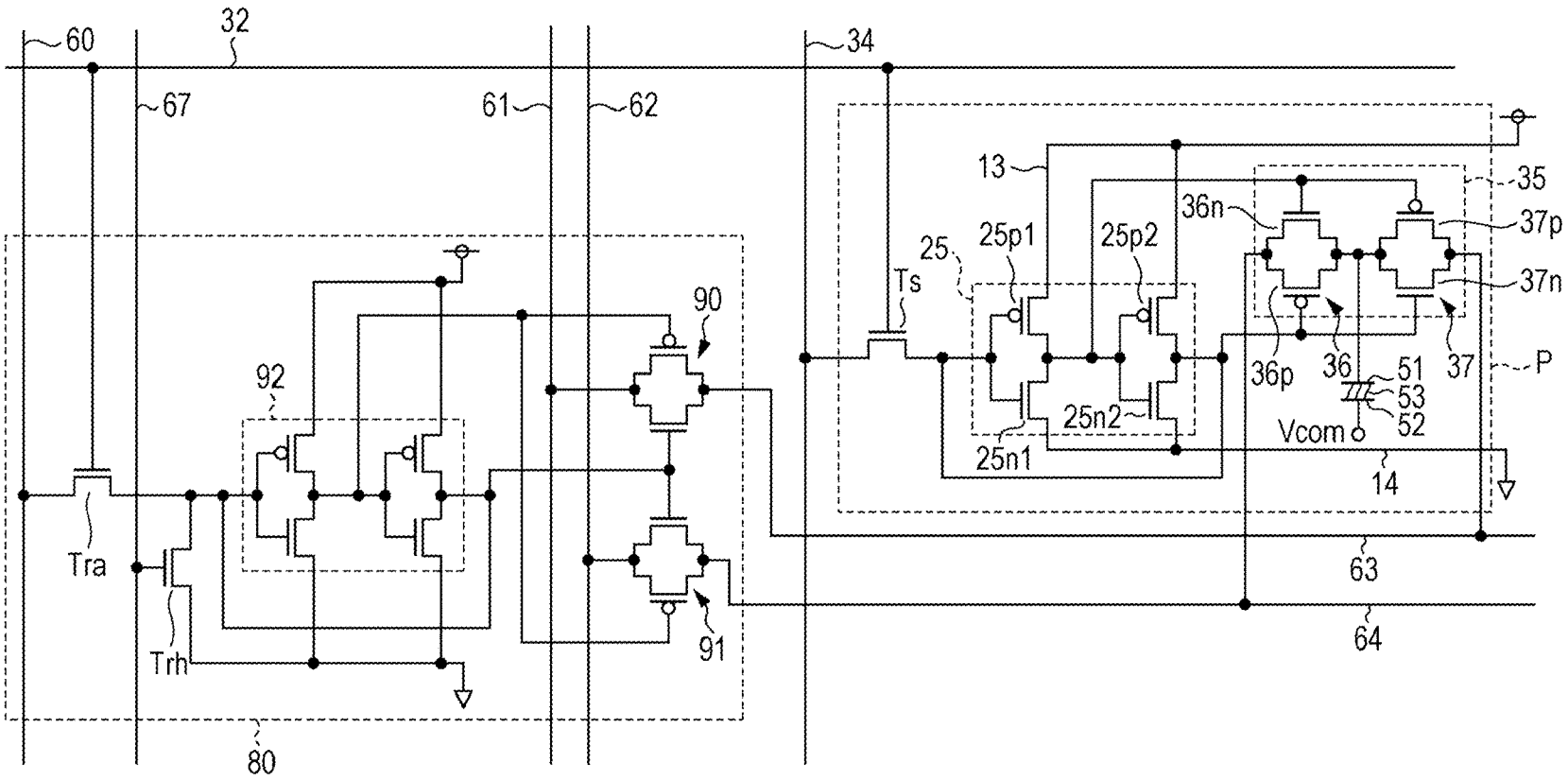
FIG. 15 is a diagram illustrating an example of the configuration of a pixel circuit according to the modification example.

In addition, as illustrated in FIGS. 10 and 13, in a case in which a memory circuit 92 is used instead of the capacitor C1, the content of the memory circuit 92 may be rest by the voltage VL using a selection switch Trh, as illustrated in FIG. 15. In the example, the selection switch Trh includes a source which is connected to the input/output terminal of the memory circuit 92, a gate section which is connected to the reset signal line 67, and a drain which is connected to the power supply line to which a voltage VSS is applied. Therefore, in a case in which the voltage VH is applied to the reset signal line 67 during the initial setting period, the selection switch Trh becomes the ON state, the input/output terminal of the memory circuit 92 becomes the voltage VL, and thus it is possible to reset the memory circuit 92 to the voltage VL.

Modification Example 2

Figure 16:
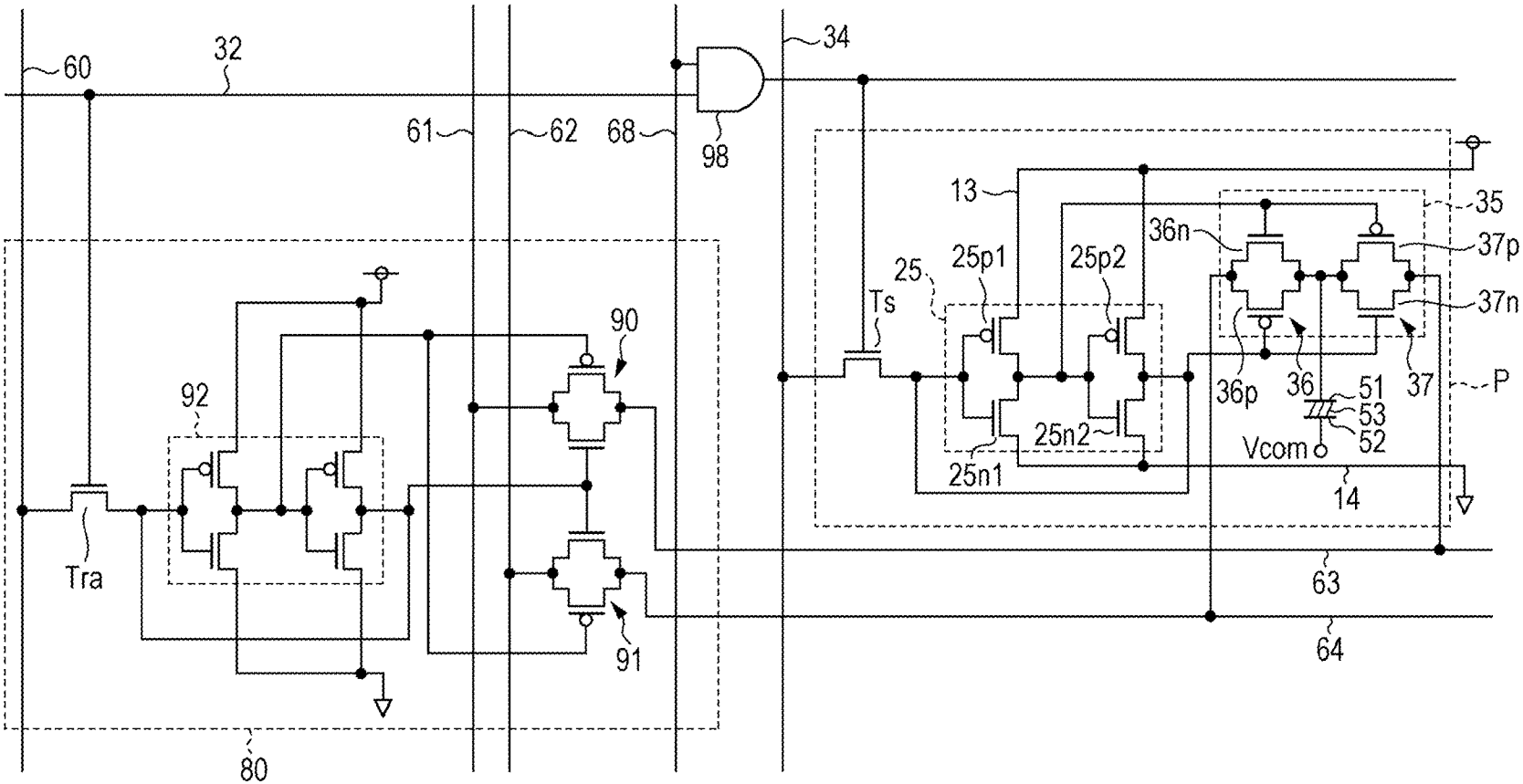
FIG. 16 is a diagram illustrating an example of the configuration of the pixel circuit according to the modification example.

In addition, a gate enabling circuit 98 using an AND circuit may be provided such that a gate signal is not transmitted to the side of the pixel circuit P in the case of the initial setting, as illustrated in FIG. 16. In the example, the gate enabling circuit 98 includes one input to which the scanning line 32 is connected and the other input to which a gate enable line 68 is connected. In such a configuration, in a case in which the voltage VL is applied to the gate enable line 68 during the initial setting period, it is possible to prevent the gate signal from being transmitted to the side of the pixel circuit P. Meanwhile, the gate enabling circuit 98 may be provided to the circuit according to the first embodiment illustrated in FIG. 2, the circuit according to the third embodiment illustrated in FIGS. 11 to 13, and the circuit according to the modification example illustrated in FIG. 15.

Modification Example 3

Figure 17:
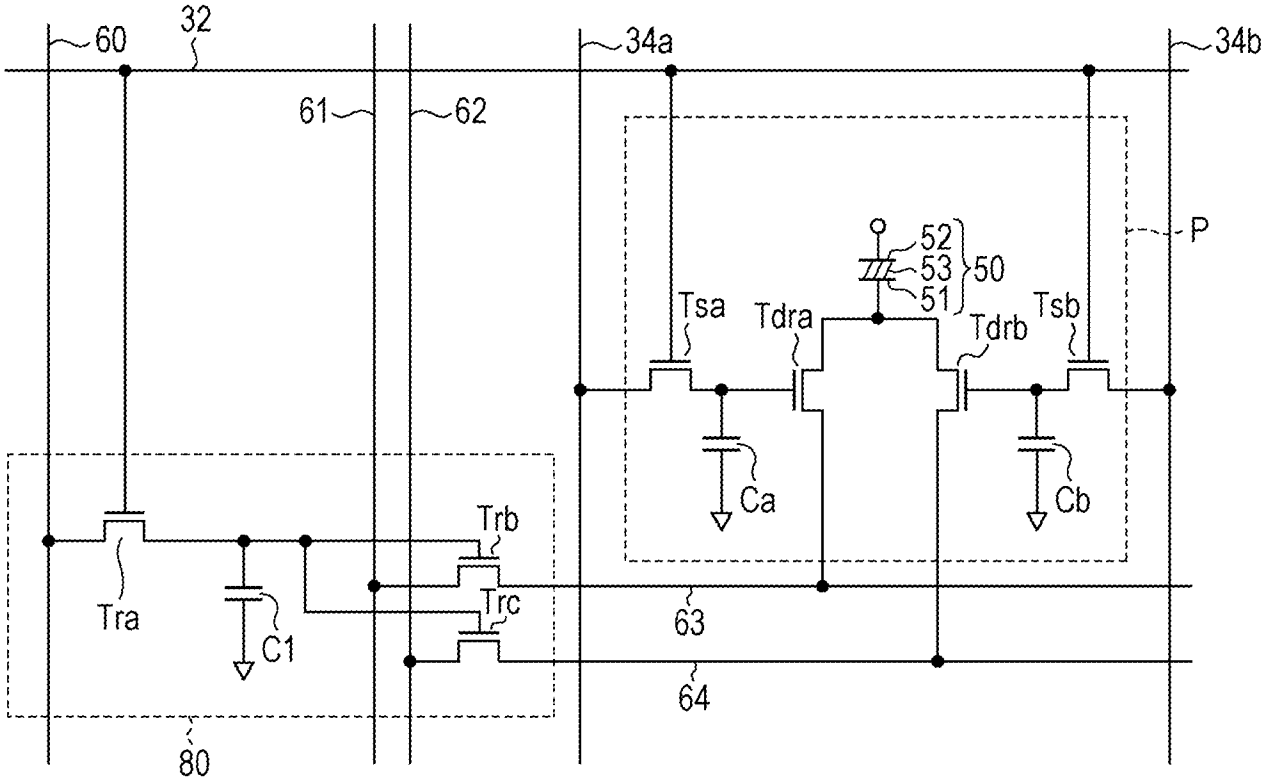
FIG. 17 is a diagram illustrating an example of the configuration of the pixel circuit according to the modification example.
Figure 18:
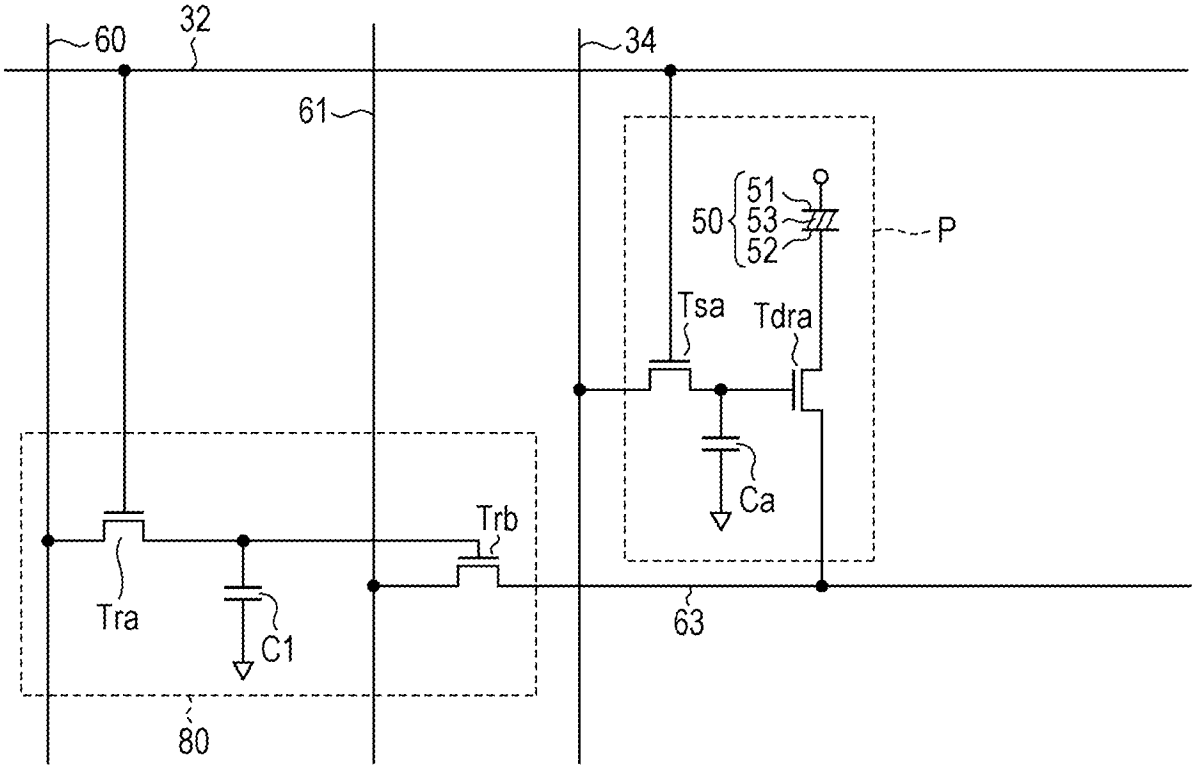
FIG. 18 is a diagram illustrating an example of the configuration of the pixel circuit according to the modification example.

The pixel circuit P may be configured as illustrated in FIG. 17 or 18. In an example of FIG. 17, data lines 34*a* and 34*b*, to which inverted data signals are respectively supplied, are provided, the selection switch includes selection switches Tsa and Tsb are provided to correspond to the data lines 34*a* and 34*b*, and capacitors Ca and Cb as pixel memory circuits are respectively connected to the selection switches Tsa and Tsb. In addition, driving transistors Tdra and Tdrb are connected to the capacitors Ca and Cb. Further, the driving transistors Tdra and Tdrb include source sides which are respectively connected to the first branched power supply line 63 and the second branched power supply line 64, and drain sides which are connected to the pixel electrode 51.

In addition, as illustrated in FIG. 18, only the selection switch Tsa as selection switch, the capacitor Ca as the pixel memory circuit, and the driving transistor Tdra may be provided. In this case, only the first branched power supply line 63 is used, and thus the second branched power supply line 64 is not necessary.

Fourth Embodiment

Figure 19:
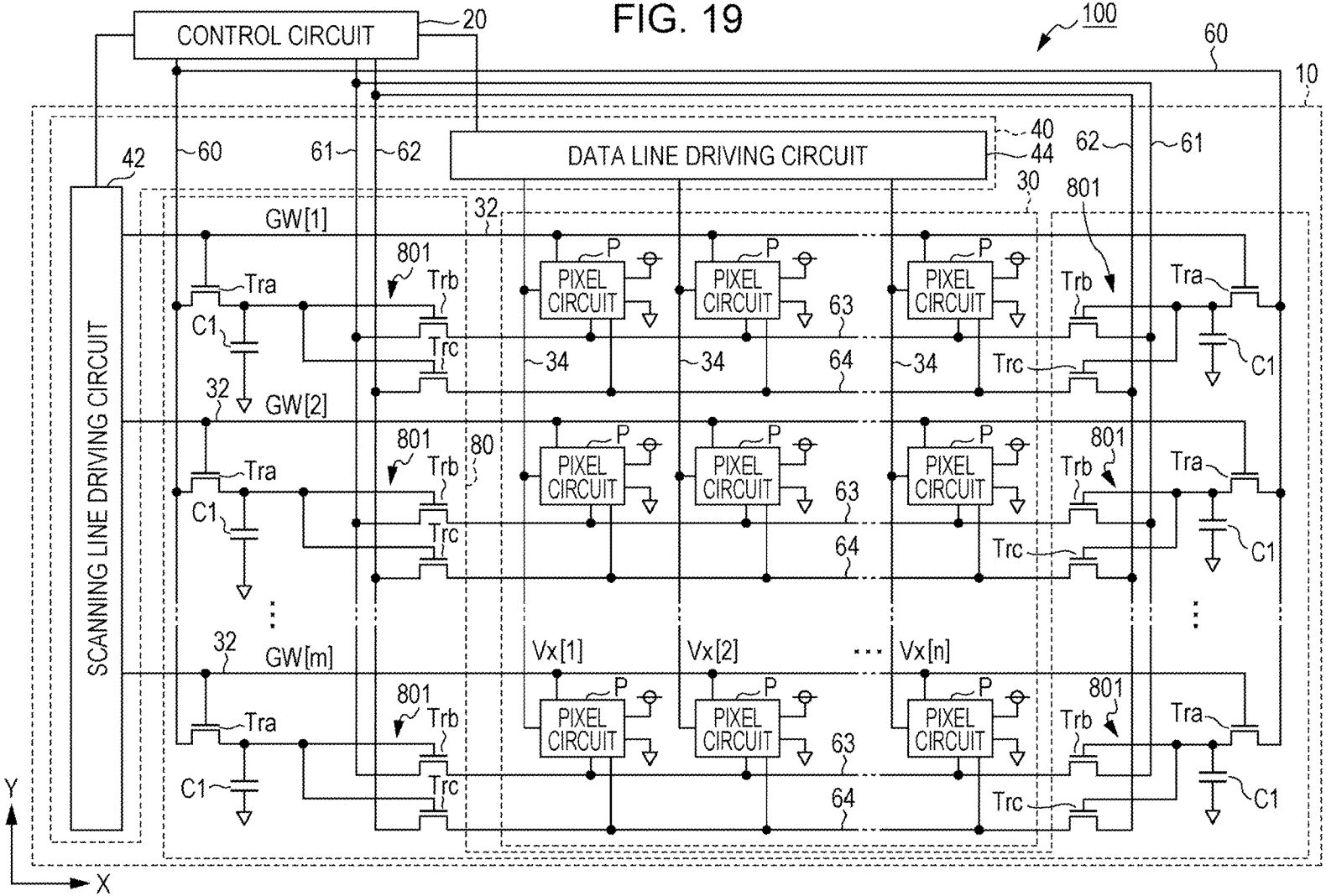
FIG. 19 is a block diagram illustrating the main configuration of a storage type display device according to a fourth embodiment of the invention.

FIG. 19 is a block diagram illustrating the main configuration of a storage type display device according to a fourth embodiment of the invention.

Hereinafter, the fourth embodiment will be described. Meanwhile, description will be performed centering on difference from the above-described embodiment and the description of the same matters will not be repeated.

As illustrated in FIG. 19, in the embodiment, the branched power supply line selecting circuit 80 includes a plurality of unit branched power supply line selecting circuits (unit power supply line switching circuits) 801, and is arranged on one end side and the other end side of the display section 30 in the X direction (row direction).

Each of the unit branched power supply line selecting circuits 801 includes a selection switch Tra, a capacitor C1, a first branched power supply line selecting switch Trb, and a second branched power supply line selecting switch Trc, is connected as described in the first embodiment, and selects the connection state between the first stem power supply line 61 and the first branched power supply line 63 and the connection state between the second stem power supply line 62 and the second branched power supply line 64, respectively.

Furthermore, the unit branched power supply line selecting circuits 801 are arranged, in respective rows, on one end side and the other end side of the display section 30 in the X direction, respectively, and two unit branched power supply line selecting circuits 801, which are arranged on the one end side and the other end side, are connected to the first branched power supply line 63 and the second branched power supply line 64 in the same row.

Meanwhile, the signal line 60, the first stem power supply line 61, and the second stem power supply line 62 are respectively branched into two lines on the way, one side thereof is connected to the unit branched power supply line selecting circuits 801, which are arranged on one side, and the other end is connected to the unit branched power supply line selecting circuits 801 which are arrange on the other end side.

According to the embodiment, the unit branched power supply line selecting circuits 801 are arranged, in the respective rows, on one end side and the other end side of the display section 30 in the X direction, respectively, and thus it is possible to dissolve or reduce display irregularities of the display section 30 in the X direction.

In addition, it is possible to exhibit the same effect as in the above-described first embodiment in the embodiment.

Meanwhile, it is possible to apply the embodiment to another embodiment and modification example.

Fifth Embodiment

Figure 20:
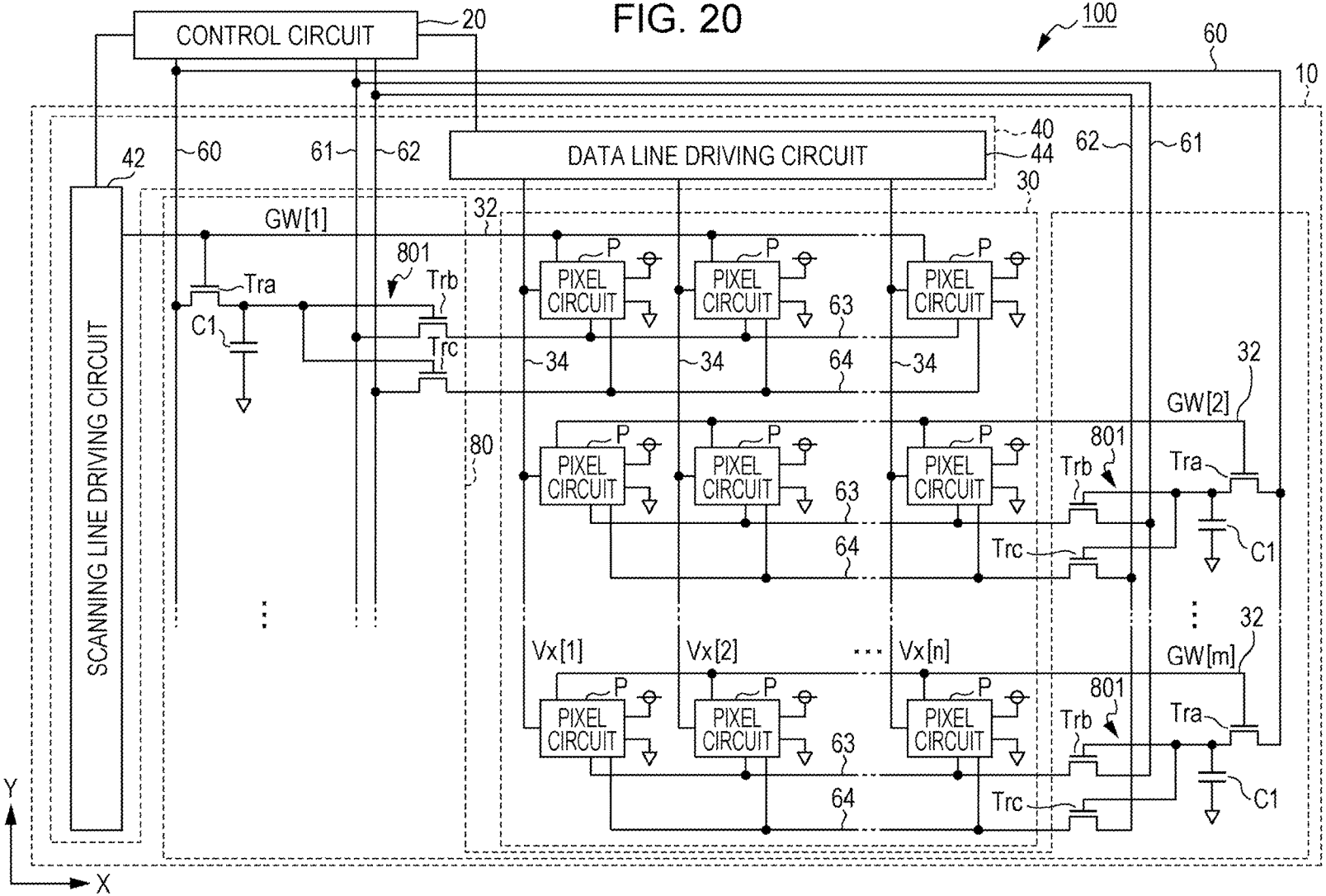
FIG. 20 is a block diagram illustrating the main configuration of a storage type display device according to a fifth embodiment of the invention.

FIG. 20 is a block diagram illustrating the main configuration of a storage type display device according to a fifth embodiment of the invention.

Hereinafter, the fifth embodiment will be described. Meanwhile, description will be performed centering on difference from the above-described first embodiment and the description of the same matters will not be repeated.

As illustrated in FIG. 20, in the embodiment, the branched power supply line selecting circuit 80 includes a plurality of unit branched power supply line selecting circuits (unit power supply line switching circuits) 801, and arranged on one end side and the other end side of the display section 30 in the X direction (row direction).

Each of the unit branched power supply line selecting circuits 801 includes the selection switch Tra, the capacitor C1, the first branched power supply line selecting switch Trb, and the second branched power supply line selecting switch Trc, is connected as described in the first embodiment, and selects the connection state between the first stem power supply line 61 and the first branched power supply line 63 and the connection state between the second stem power supply line 62 and the second branched power supply line 64, respectively.

Furthermore, the unit branched power supply line selecting circuits 801 are alternately arranged on one end side and the other end side of the display section 30 in the X direction. That is, on one end side of the display section 30 in the X direction, the unit branched power supply line selecting circuits 801 are arranged in every other row, and, on the other end side, the unit branched power supply line selecting circuits 801 are arranged in every other row, that is, arranged to be deviated by one row for the one end side.

Meanwhile, each of the signal line 60, the first stem power supply line 61 and the second stem power supply line 62 is branched into two parts on the way. One part is connected to the unit branched power supply line selecting circuits 801 which are arranged on one end side and the other part is connected to the unit branched power supply line selecting circuits 801 which are arranged on the other end side.

According to the embodiment, the direction of the display irregularities of the display section 30 in the X direction becomes reverse direction for each row, and thus the display irregularities are cancel out or reduced in the X direction of the display section 30.

In addition, it is possible to exhibit the same effect as in the above-described first embodiment in the embodiment.

Meanwhile, in the embodiment, the unit branched power supply line selecting circuits 801 are alternately arranged in one row unit on one end side and the other end side of the display section 30 in the X direction. However, the invention is not limited thereto. For example, as a configuration example in which one unit branched power supply line selecting circuit 801 is arranged in one row, and the unit branched power supply line selecting circuits 801 may be alternately arranged in plural row units (for example, two row units). In addition, the unit branched power supply line selecting circuits 801 may be alternately arranged regularly (with regularity), and may be alternately arranged irregularly.

That is, the unit branched power supply line selecting circuits 801 may be arranged one end side and the other end side of the display section 30 in the row direction, and one unit branched power supply line selecting circuit 801 may be provided for one (one group) first branched power supply line 63 and the second branched power supply line 64 (one branched power supply line).

In addition, it is possible to apply the embodiment to other embodiments and modification examples.

Sixth Embodiment

Figure 21:
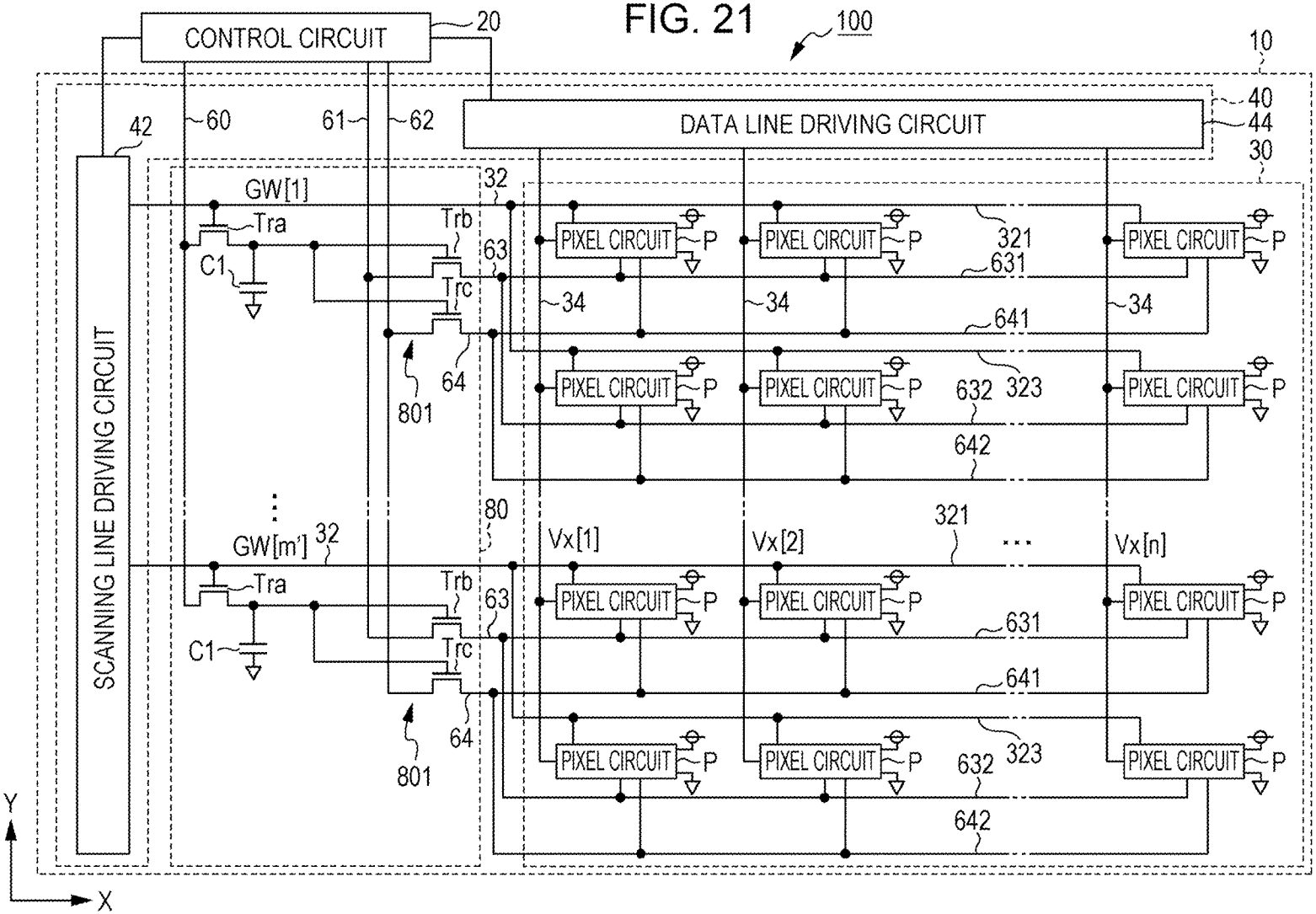
FIG. 21 is a block diagram illustrating the main configuration of a storage type display device according to a sixth embodiment of the invention.

FIG. 21 is a block diagram illustrating the main configuration of a storage type display device according to a sixth embodiment of the invention.

Hereinafter, the sixth embodiment will be described. Meanwhile, description will be performed centering on difference from the above-described first embodiment and the description of the same matters will not be repeated.

As illustrated in FIG. 21, in the embodiment, the branched power supply line selecting circuit 80 includes a plurality of unit branched power supply line selecting circuits (unit power supply line switching circuits) 801, and is arranged on one end side of the display section 30 in the X direction (row direction).

Each of the unit branched power supply line selecting circuits 801 includes the selection switch Tra, the capacitor C1, the first branched power supply line selecting switch Trb, and the second branched power supply line selecting switch Trc, and is connected as described in the first embodiment.

Furthermore, in the embodiment, one unit branched power supply line selecting circuit 801 is provided for the pixel circuits P corresponding to two adjacent rows.

In this case, the scanning line 32 is branched into two parts on the way. One side scanning line 321, acquired after branching, is connected to the pixel circuit P which belongs to one of the two rows, and the other side scanning line 323, acquired after branching, is connected to the pixel circuit P which belongs to the remaining one of the two rows.

Similarly, first branched power supply line 63 is branched into two parts on the way. One side first branched power supply line 631, acquired after branching, is connected to the is connected to the pixel circuit P which belongs to one of the two rows, and the other side first branched power supply line 632, acquired after branching, is connected to the pixel circuit P which belongs to the remaining one of the two rows.

Similarly, the second branched power supply line 64 is branched into two parts on the way. One side second branched power supply line 641, acquired after branching, is connected to the pixel circuit P which belongs to one of the two rows, and the other side second branched power supply line 642, acquired after branching, is connected to the pixel circuit P which belongs to the remaining one of the two rows.

The unit branched power supply line selecting circuits 801 respectively select connection states between the first stem power supply line 61 and the first branched power supply lines 631 and 632, and the connection states between the second stem power supply line 62 and the second branched power supply lines 641 and 642, respectively.

As described above, in the embodiment, the branched power supply line selecting circuit 80 is connected between the first stem power supply line 61 and the first branched power supply lines 631 and 632 for each two rows and between the second stem power supply line 62 and the second branched power supply lines 641 and 642 for each two rows, respectively, and selects the connection state between the first stem power supply line 61 and the first branched power supply lines 631 and 632 for each two rows and the connection state between the second stem power supply line 62 and the second branched power supply lines 641 and 642 for each two rows, respectively. In addition, the control circuit 20 disconnects or connects, for each two rows, the first stem power supply line 61 from or to the first branched power supply lines (that is, the first branched power supply lines 631 and 632), and the second stem power supply line 62 from or to the second branched power supply lines (that is, the second branched power supply lines 641 and 642) according to whether or not content, which is stored in the memory circuit 25, is rewritten.

Meanwhile, m' in the scanning signals (signal) GW[1] to GW[m'] is ½ of m in the scanning signals GW[1] to GW[m] of the first embodiment.

According to the embodiment, it is possible to reduce the number of unit branched power supply line selecting circuits 801, that is, it is possible to reduce the scale of the branched power supply line selecting circuit 80. Therefore, the electric power consumption is reduced and it is possible to reduce the dimensions of the frames (non-display areas) on the outer side of the display section 30.

In addition, the embodiment is especially effective, for example, in a case in which the location of the partial row, in which rewriting is performed, or the number of rows is determined. A plurality of rows, on which the same control is performed, are collected and one unit branched power supply line selecting circuit 801 is provided for the collected rows.

In addition, it is possible to exhibit the same effect as in the above-described first embodiment in the embodiment.

Meanwhile, in the embodiment, one unit branched power supply line selecting circuit 801 is provided for the pixel circuits P corresponding to two rows. However, the invention is not limited thereto. One unit branched power supply line selecting circuit 801 may be provided for the pixel circuits P corresponding to three or more rows. In addition, the plurality of rows, in which one unit branched power supply line selecting circuit 801 is provided, may not be adjacent.

In addition, it is possible to apply the embodiment to other embodiments and modification examples.

Seventh Embodiment

Figure 22:
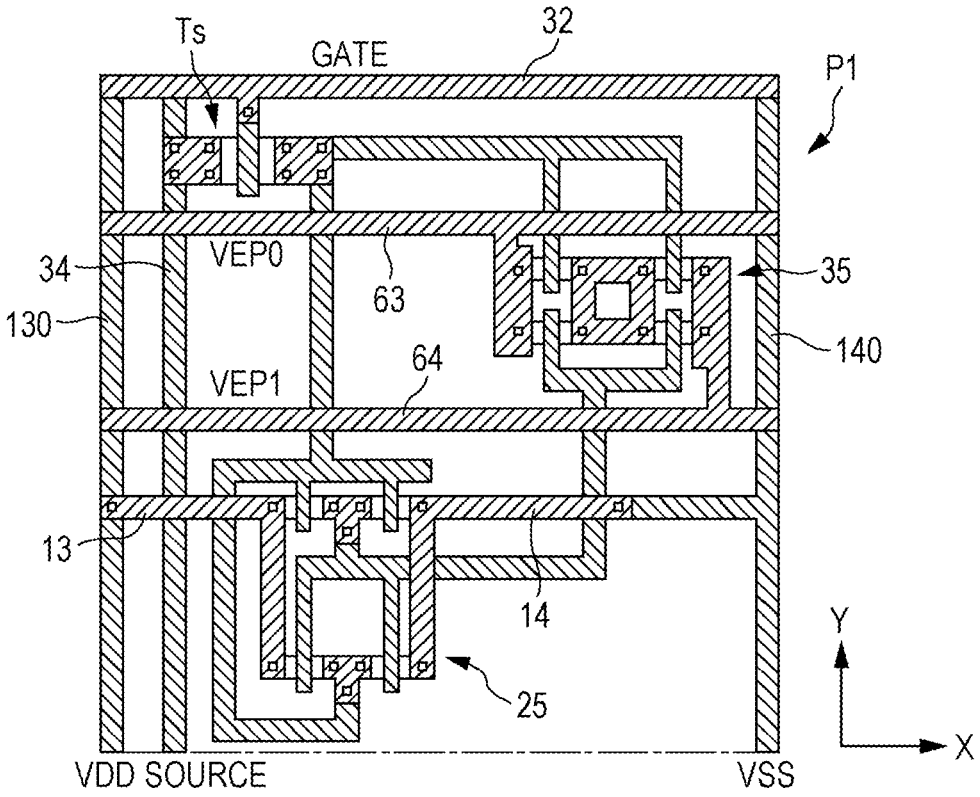
FIG. 22 is a pattern layout diagram illustrating the main configuration of a storage type display device according to a seventh embodiment of the invention.
Figure 23:
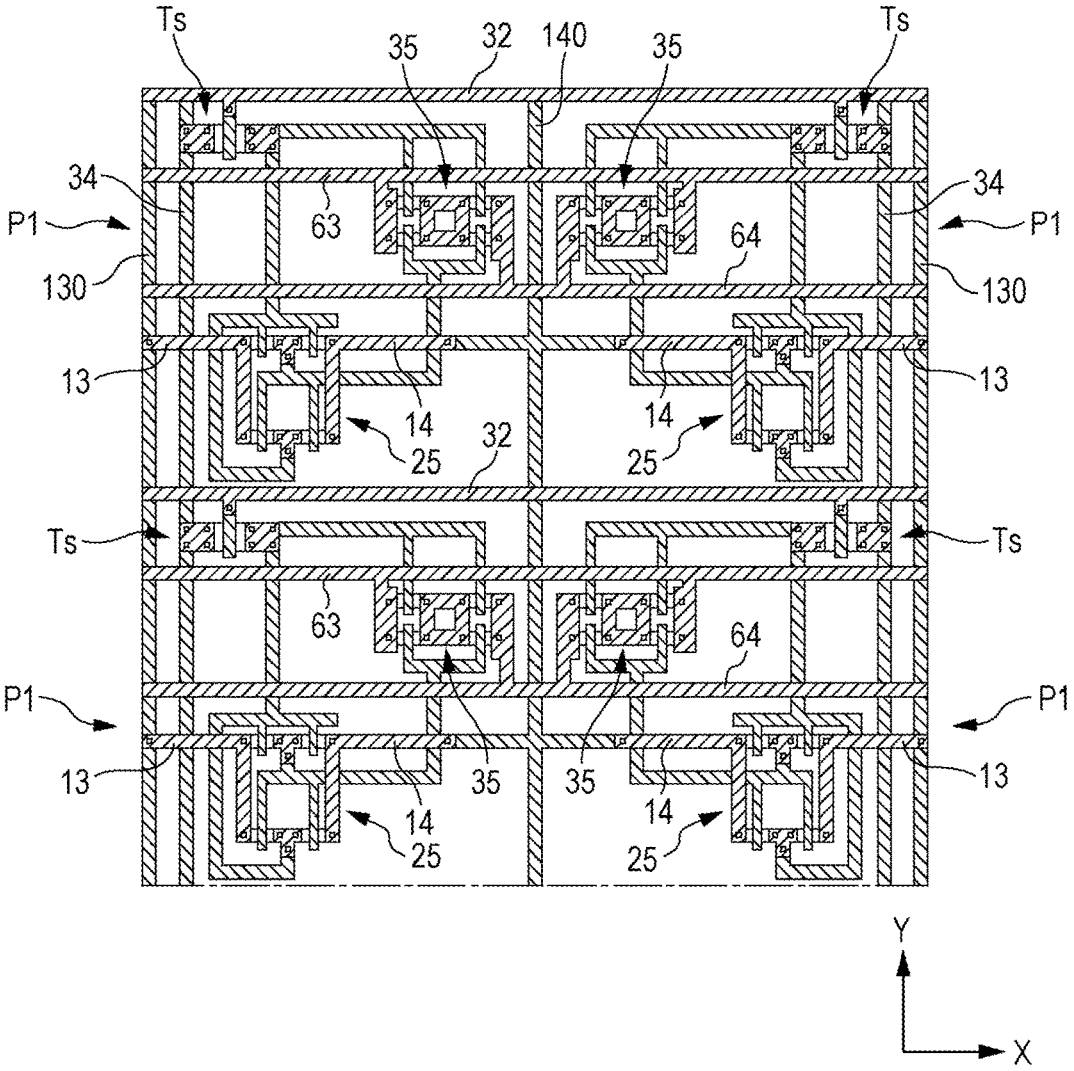
FIG. 23 is a pattern layout diagram illustrating the main configuration of a storage type display device according to a seventh embodiment of the invention.

FIGS. 22 and 23 are pattern layout diagrams respectively illustrating the main configuration of a storage type display device according to a seventh embodiment of the invention.

Hereinafter, the seventh embodiment will be described. Meanwhile, description will be performed centering on difference from the above-described embodiment and the description of the same matters will not be repeated.

In the embodiment, a pixel circuit P1 corresponding to one pixel has a configuration illustrated in FIG. 22.

In addition, the first power supply line 13 of the pixel circuit P1 is connected to the first common power supply line 130, and the second power supply line 14 is connected to the second common power supply line 140. The first common power supply line 130 is connected to the high potential side of the power, and the second common power supply line 140 is connected to the low potential side of the power or the earth. In addition, the first common power supply line 130 extends in the Y direction, and is arranged on the left side of the pixel circuit P1 in FIG. 22. The second common power supply line 140 extends in the Y direction, and is arranged on the right side of the pixel circuit P1 in FIG. 22. In addition, the first branched power supply line 63 and the second branched power supply line 64 extend in the X direction, respectively, and are arranged inside the pixel circuit P1 in the Y direction.

The electrophoretic display device 100 includes the pixel circuits P1 which are arranged in a matrix shape of vertical m rows and horizontal n columns.

FIG. 23 illustrates the pixel circuits P1 corresponding to 2 rows×2 columns. Meanwhile, on the left side of FIG. 23, the pixel circuits P1 in the posture illustrated in FIG. 22 are arranged. On the right side of FIG. 23, a pixel circuit, which is acquired by reversing the pixel circuit P1 in the posture illustrated in FIG. 22 in the X direction, is arranged.

Therefore, it is possible to share the second common power supply line 140 by two pixel circuits P1, which are adjacent in the X direction, that is, the two columns of pixel circuits P1.

In addition, although not illustrated in the drawing, on the right side of the pixel circuit P1 on the right side of FIG. 23, a pixel circuit, which is acquired by reversing the pixel circuit P1 on the right side of FIG. 23 in the X direction, that is, the pixel circuit P1 in the posture illustrated in FIG. 22 is arranged.

Therefore, it is possible to share the first common power supply line 130 by two pixel circuits P1, which are adjacent in the X direction, that is, the two columns of pixel circuits P1.

As described above, according to the embodiment, it is possible to share the first common power supply line 130 and the second common power supply line 140 by the two columns of pixel circuits P1 which are adjacent in the X direction. Therefore, it is possible to reduce the pixel pitch in the X direction, and thus it is possible to improve high definition and it is possible to simplify the configuration of the circuit.

In addition, it is possible to exhibit the same effect as in the above-described first embodiment in the embodiment.

Meanwhile, it is possible to apply the embodiment to other embodiments and modification examples.

Eighth Embodiment

Figure 24:
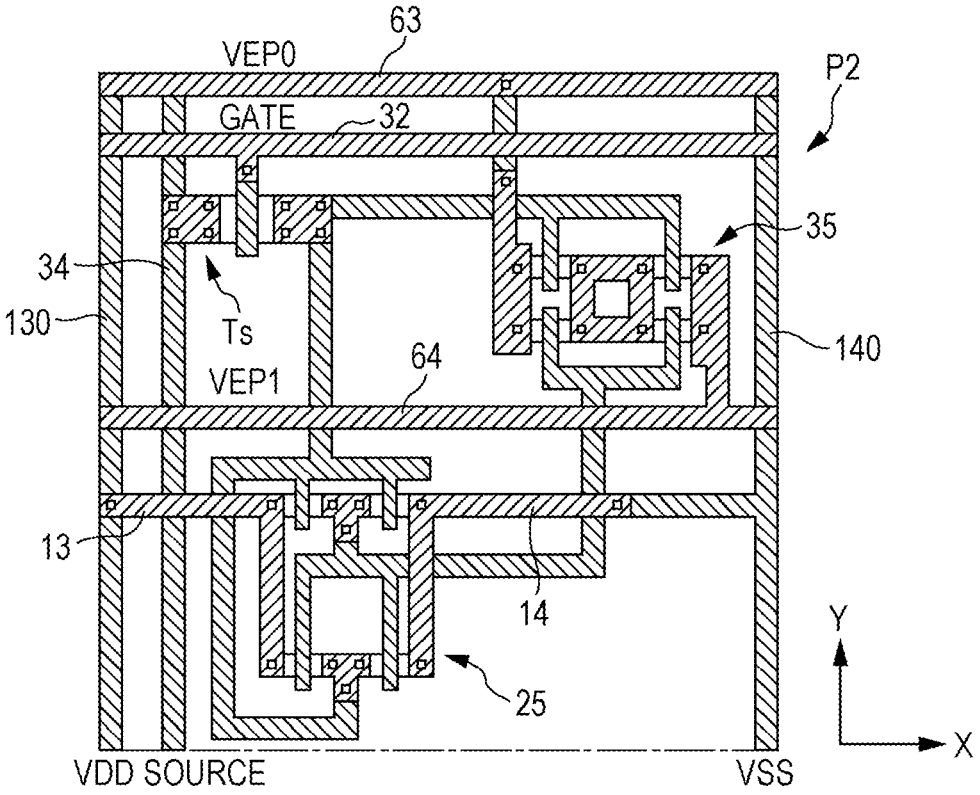
FIG. 24 is a pattern layout diagram illustrating the main configuration of a storage type display device according to an eighth embodiment of the invention.
Figure 25:
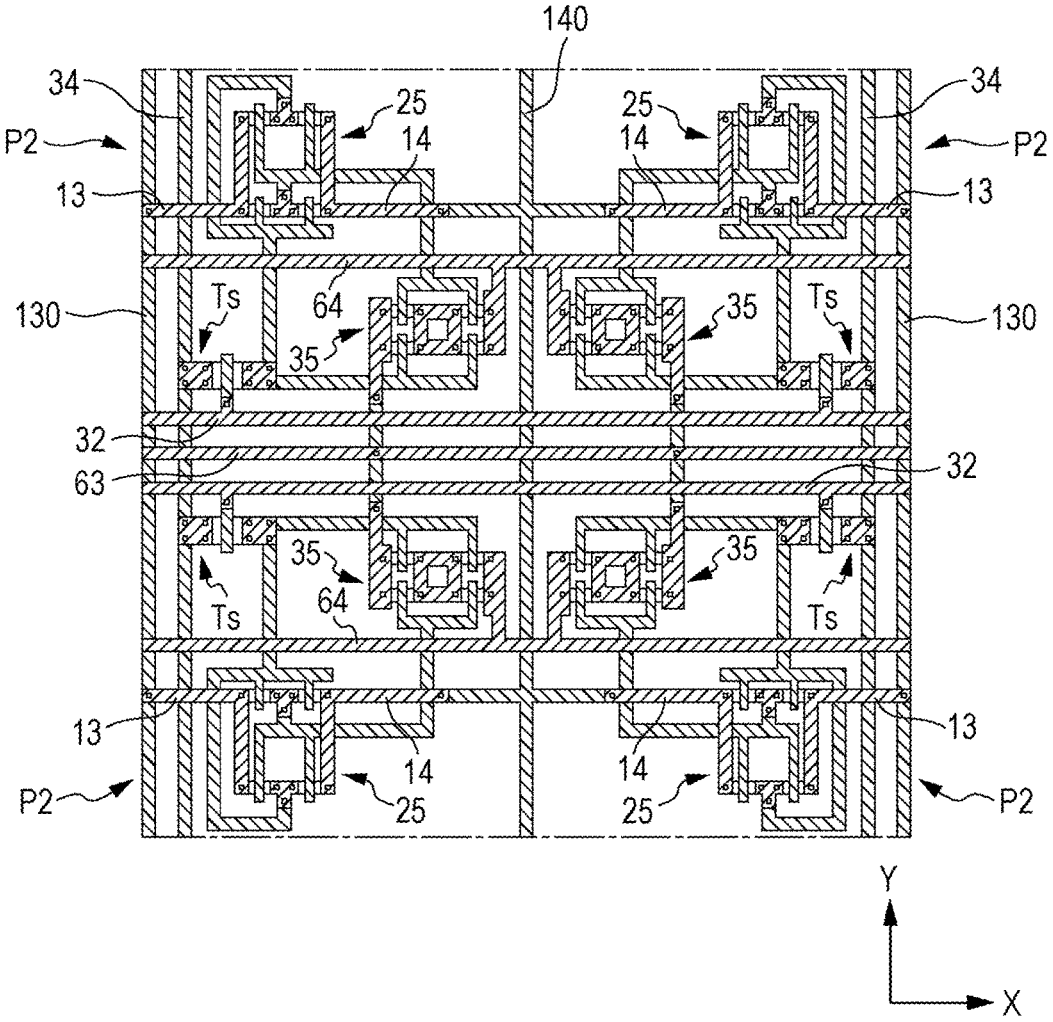
FIG. 25 is a pattern layout diagram illustrating the main configuration of a storage type display device according to an eighth embodiment of the invention.

FIGS. 24 and 25 are pattern layout diagrams respectively illustrating the main configuration of a storage type display device according to an eighth embodiment of the invention.

Hereinafter, the eighth embodiment will be described. Meanwhile, description will be performed centering on difference from the above-described embodiment and the description of the same matters will not be repeated.

In the embodiment, a pixel circuit P2 corresponding to one pixel has a configuration illustrated in FIG. 24.

In addition, the first power supply line 13 of the pixel circuit P2 is connected to the first common power supply line 130, and the second power supply line 14 is connected to the second common power supply line 140. The first common power supply line 130 is connected to the high potential side of the power, and the second common power supply line 140 is connected to the low potential side of the power or the earth. In addition, the first common power supply line 130 extends in the Y direction, and is arranged on the left side of the pixel circuit P2 in FIG. 24. The second common power supply line 140 extends in the Y direction, and is arranged on the right side of the pixel circuit P2 in FIG. 24. In addition, the first branched power supply line 63 extends in the X direction, and is arranged on the upper side of the pixel circuit P2 in FIG. 24. In addition, the second branched power supply line 64 extends in the X direction, and is arranged inside the pixel circuit P2 in the Y direction.

The electrophoretic display device 100 includes the pixel circuits P2 which are arranged in a matrix shape of vertical m rows and horizontal n columns.

In FIG. 25, the pixel circuits P2 corresponding to 2 rows×2 columns are illustrated. Meanwhile, in the lower left of FIG. 25, the pixel circuit P2 in the posture illustrated in FIG. 24 is arranged, and, in the lower right of FIG. 25, a pixel circuit, which is acquired by reversing the pixel circuit P2 in the posture illustrated in FIG. 24 in the X direction, is arranged. In addition, in the upper left of FIG. 25, a pixel circuit, which is acquired by reversing the pixel circuit P2 in the posture illustrated in FIG. 24 in the Y direction, is arranged, and, in the upper right of FIG. 25, a pixel circuit, which is acquired by reversing the pixel circuit P2 in the posture illustrated in FIG. 24 in the X direction and in the Y direction, respectively, is arranged.

Therefore, it is possible to share the second common power supply line 140 by the two pixel circuits P2 which are adjacent in the X direction, that is, the pixel circuits P2 corresponding to two columns. In addition, it is possible to share the first branched power supply line 63 by two pixel circuits P2 which are adjacent in the Y direction, that is, pixel circuits P2 corresponding to two rows.

In addition, although not illustrated in the drawing, on the right side of the pixel circuit P2 on the upper right side of FIG. 25, the pixel circuit, which is acquired by reversing the pixel circuit P2 on the upper right side of FIG. 25 in the X direction, that is, a pixel circuit, which is acquired by reversing the pixel circuit P2 in the posture illustrated in FIG. 24 in the Y direction, is arranged. On the right side of the pixel circuit P2 in the lower right of FIG. 25, a pixel circuit, which is acquired by reversing the pixel circuit P2 in the lower right of FIG. 25 in the X direction, that is, the pixel circuit P2 in the posture illustrated in FIG. 24 is arranged.

Therefore, it is possible to share the first common power supply line 130 by two pixel circuits P2 which are adjacent in the X direction, that is, the pixel circuit P2 corresponding to two columns.

Meanwhile, in a case of the embodiment, one first branched power supply line selecting switch Trb of the unit branched power supply line selecting circuit 801 is provided for two rows, and one second branched power supply line selecting switch Trc is provided for one row.

As described above, according to the embodiment, it is possible to share the first common power supply line 130 and the second common power supply line 140 by two columns of pixel circuits P2 which are adjacent in the X direction, and it is possible to share the first branched power supply line 63 by two rows of pixel circuits P2 which are adjacent in the Y direction. Therefore, it is possible to reduce the pixel pitch in the X direction and the pixel pitch in the Y direction, and thus it is possible to improve high definition and it is possible to simplify the configuration of the circuit.

In addition, it is possible to exhibit the same effect as in the above-described first embodiment in the embodiment.

Meanwhile, any one of the reversal of the pixel circuit P2 in the Y direction and the reversal of the pixel circuit P2 in the X direction may be omitted.

In addition, it is possible to apply the embodiment to other embodiments and modification examples.

Ninth Embodiment

Figure 26:
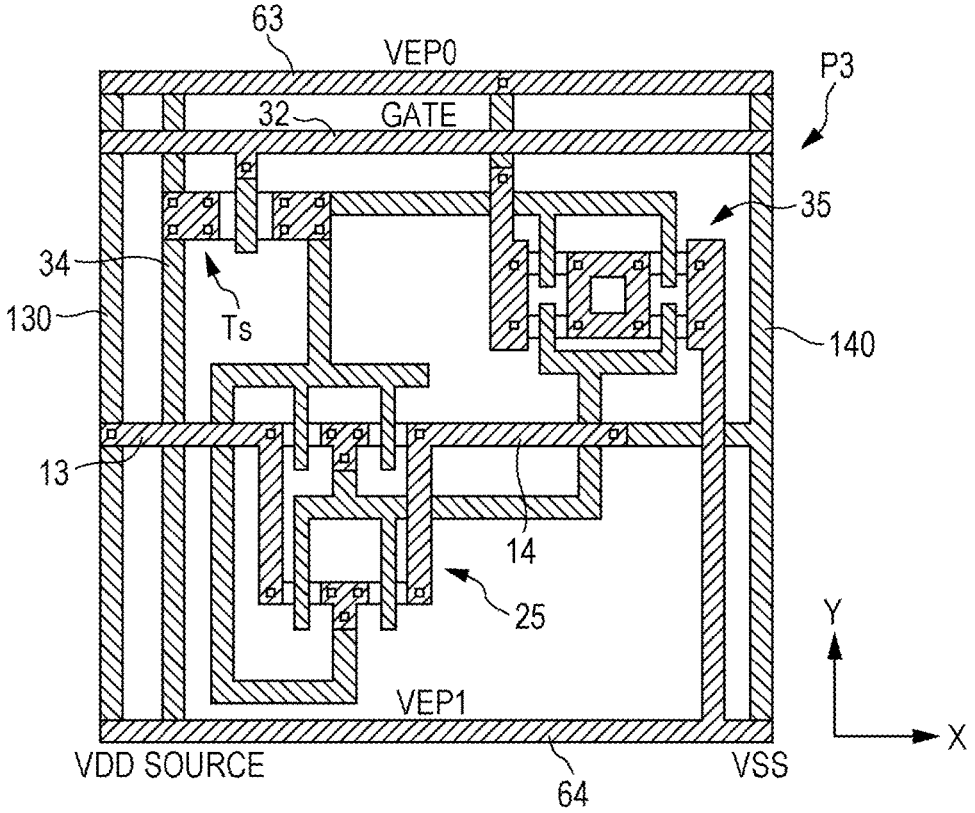
FIG. 26 is a pattern layout diagram illustrating the main configuration of a storage type display device according to a ninth embodiment of the invention.
Figure 27:
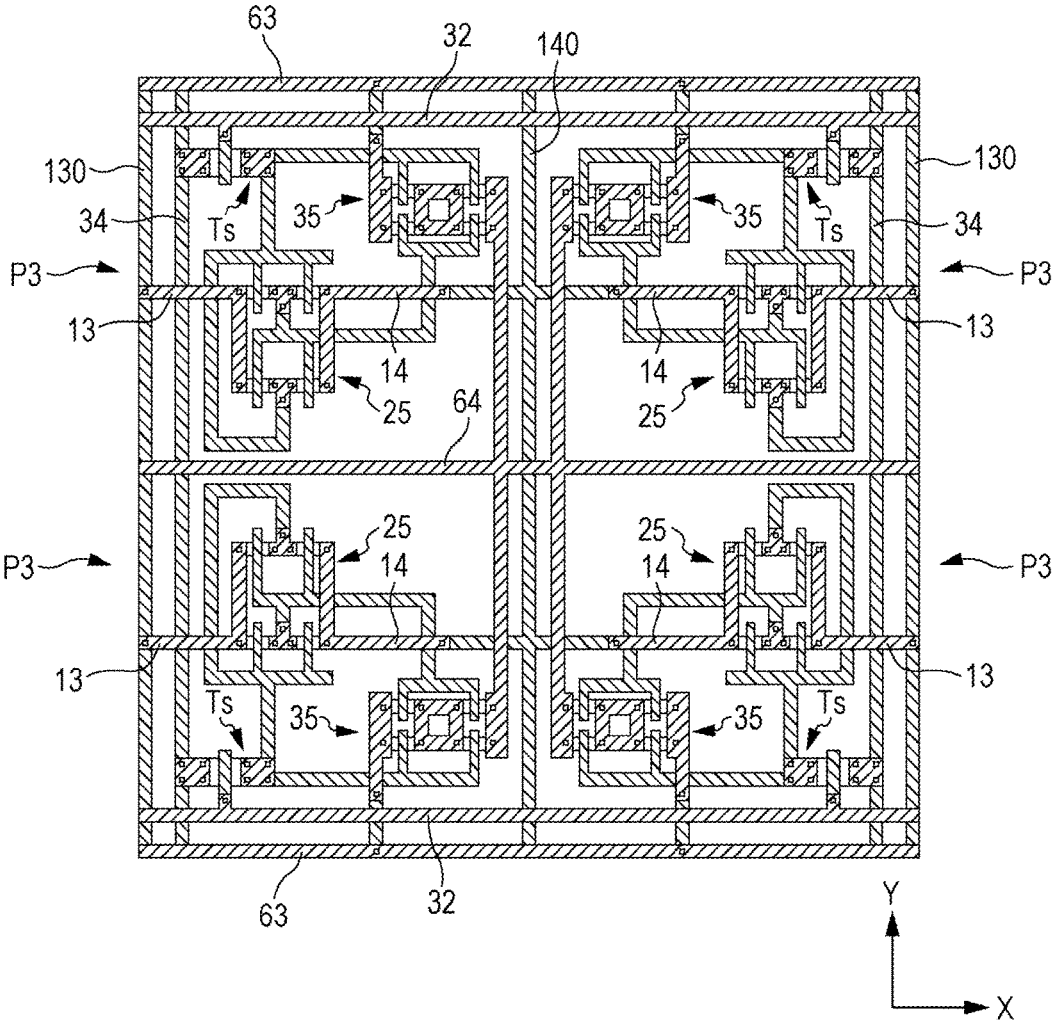
FIG. 27 is a pattern layout diagram illustrating the main configuration of a storage type display device according to the ninth embodiment of the invention.

FIGS. 26 and 27 are pattern layout diagrams illustrating the main configuration of a storage type display device according to a ninth embodiment of the invention.

Hereinafter, the ninth embodiment will be described. Meanwhile, description will be performed centering on difference from the above-described embodiment and the description of the same matters will not be repeated.

In the embodiment, a pixel circuit P3 corresponding to one pixel has a configuration illustrated in FIG. 26.

In addition, the first power supply line 13 of the pixel circuit P3 is connected to the first common power supply line 130, and the second power supply line 14 is connected to the second common power supply line 140. The first common power supply line 130 is connected to the high potential side of the power, and the second common power supply line 140 is connected to the low potential side of the power or the earth. In addition, the first common power supply line 130 extends in the Y direction, and is arranged on the left side of the pixel circuit P3 in FIG. 26. The second common power supply line 140 extends in the Y direction, and is arranged on the right side of the pixel circuit P3 in FIG. 26. In addition, the first branched power supply line 63 extends in the X direction, and is arranged on the upper side of the pixel circuit P3 in FIG. 26. In addition, the second branched power supply line 64 extends in the X direction, and is arranged on the lower side of the pixel circuit P3 in FIG. 26.

The electrophoretic display device 100 includes the pixel circuits P3 which are arranged in a matrix shape of vertical m rows and horizontal n columns.

FIG. 27 illustrates pixel circuits P3 corresponding to 2 rows×2 columns. Meanwhile, in the upper left of FIG. 27, the pixel circuit P3 in the posture illustrated in FIG. 26 is arranged, and, in the upper right of FIG. 27, a pixel circuit, which is acquired by reversing the pixel circuit P3 in the posture illustrated in FIG. 26 in the X direction, is arranged. In addition, in the lower left of FIG. 27, a pixel circuit, which is acquired by reversing the pixel circuit P3 in the posture illustrated in FIG. 26 in the Y direction, is arranged, and in the lower right of FIG. 27, a pixel circuit, which is acquired by reversing the pixel circuit P3 in the posture illustrated in FIG. 26 in the X direction and the Y direction, is arranged.

Therefore, it is possible to share the second common power supply line 140 by two pixel circuits P3 which are adjacent in the X direction, that is, two columns of pixel circuits P3. In addition, it is possible to share the second branched power supply line 64 by two pixel circuits P3 which are adjacent in the Y direction, that is, two rows of pixel circuit P3.

In addition, although not illustrated in the drawing, on the right side of the pixel circuit P3 in the upper right of FIG. 27, a pixel circuit, which is acquired by reversing the pixel circuit P3 in the upper right of FIG. 27 in the X direction, that is, the pixel circuit P3 in the posture illustrated in FIG. 26 is arranged. On the right side of the pixel circuit P3 in the lower right of FIG. 27, a pixel circuit, which is acquired by reversing the pixel circuit P3 in the lower right of FIG. 27 in the X direction, that is, a pixel circuit, which is acquired by reversing the pixel circuit P3 in the posture illustrated in FIG. 26 in the Y direction, is arranged.

Therefore, it is possible to share the first common power supply line 130 by two pixel circuits P3 which are adjacent in the X direction, that is, two columns of pixel circuits P3.

In addition, although not illustrated in the drawing, on the lower side of the pixel circuit P3 in the lower left of FIG. 27, a pixel circuit, which is acquired by reversing the pixel circuit P3 in the lower left of FIG. 27 in the Y direction, that is, the pixel circuit P3 in the posture illustrated in FIG. 26 is arranged. In the lower side of the pixel circuit P3 in the lower right of FIG. 27, a pixel circuit, which is acquired by reversing the pixel circuit P3 in the lower right of FIG. 27 in the Y direction, is arranged.

Therefore, it is possible to share the first branched power supply line 63 by two pixel circuits P3 which are adjacent in the Y direction, that is, two rows of pixel circuits P3.

Meanwhile, in a case of the embodiment, one first branched power supply line selecting switch Trb and one second branched power supply line selecting switch Trc of the unit branched power supply line selecting circuit 801 are respectively provided for two rows.

As described above, according to the embodiment, it is possible to share the first common power supply line 130 and the second common power supply line 140 by the two columns of pixel circuits P3 which are adjacent in the X direction and it is possible to share the first branched power supply line 63 and the second branched power supply line 64 by the two rows of pixel circuits P3 which are adjacent in the Y direction. Therefore, it is possible to reduce the pixel pitch in the X direction and the pixel pitch in the Y direction, and thus it is possible to improve high definition and it is possible to simplify the configuration of the circuit.

In addition, it is possible to exhibit the same effect as in the above-described first embodiment in the embodiment.

Meanwhile, any one of the reversal of the pixel circuit P3 in the Y direction and the reversal of the pixel circuit P3 in the X direction may be omitted.

In addition, it is possible to apply the embodiment to other embodiments and modification examples.

Application Example

Figure 28:
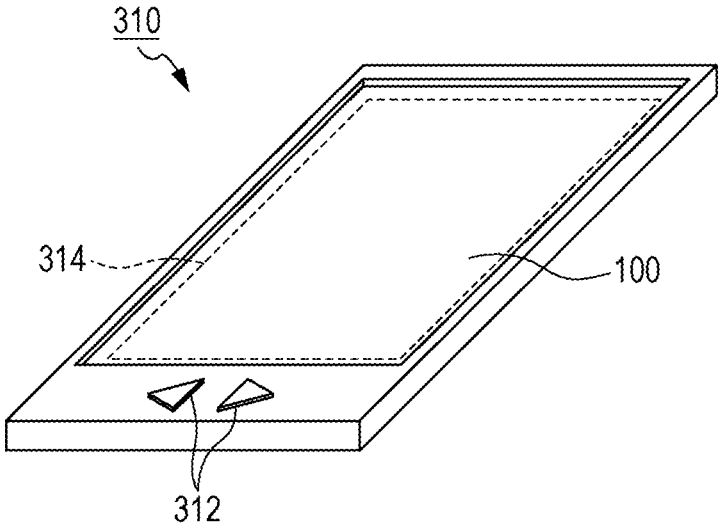
FIG. 28 is an oblique drawing illustrating an electronic apparatus (information terminal).
Figure 29:
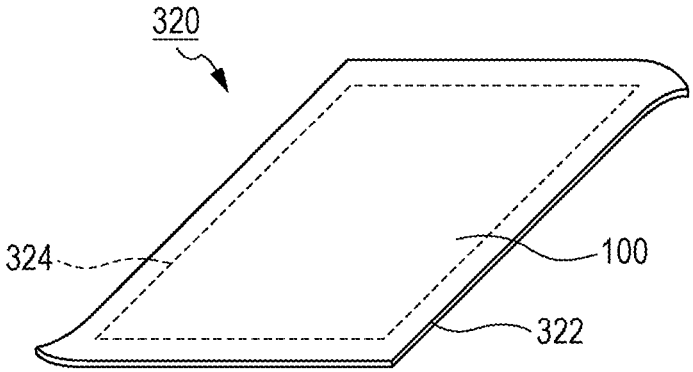
FIG. 29 is an oblique drawing illustrating an electronic apparatus (electronic paper).

An electronic apparatus to which the invention is applied will be described below. FIGS. 28 and 29 illustrate the appearances of electronic apparatuses in which the above-described electrophoretic display device 100 is used.

FIG. 28 is an oblique drawing illustrating a portable information terminal (electronic book) 310 using the electrophoretic display device 100. As illustrated in FIG. 28, the information terminal 310 includes operating units 312 which are operated by a user, and an electrophoretic display device 100 which displays an image on a display section 314. In a case in which the operating units 312 are operated, the display image of the display section 314 is changed.

FIG. 29 is an oblique drawing illustrating electronic paper 320 using the electrophoretic display device 100. As illustrated in FIG. 29, the electronic paper 320 includes the electrophoretic display device 100 which is formed on the surface of a flexible substrate (sheet) 322.

The electronic apparatuses, to which the invention is applied, are not limited to the above examples. It is possible to use the electrophoretic display device according to the invention for, for example, various types of electronic apparatus (storage type display device), such as a mobile phone, a clock (wrist watch), a portable sound reproduction device, an electronic organizer, and a touch panel mounted display device.

In addition, the display element according to the invention is not limited to the electrophoretic element, and can be applied to an electrochromic element, a liquid crystal element, or the like. Therefore, the storage type display device according to the invention is not limited to the electrophoretic display device, and can be applied to an electrochromic display device or a liquid crystal display device, which has a memory. In addition, as an example of the electronic apparatus, it is possible to use the storage type display device according to the invention for various types of electronic apparatuses, such as an information terminal, a mobile phone or a clock (wrist watch), a portable sound reproduction device, an electronic organizer, and a touch panel-mounted display device, using the electrochromic display device or the liquid crystal display device.

Hereinabove, the storage type display device and the electronic apparatus according to the invention have been described based on the embodiments illustrated in the drawings. However, the invention is not limited thereto, and it is possible to replace the configurations of the respective sections by arbitrary configurations which have the same functions. In addition, other arbitrary components may be added.

In addition, the invention may be realized by combining arbitrary two or more configurations (features) of the respective embodiments and the respective modification examples.

The entire disclosure of Japanese Patent Application No. 2015-124855, filed Jun. 22, 2015 is expressly incorporated by reference herein.

What is claimed is:

1. A storage type display device comprising:

first control lines that are provided in as many as n (n is an integer which is equal to or larger than 2) columns;

second control lines that are provided in as many as m (m is an integer which is equal to or larger than 2) rows; and a display section that includes display elements interposed between a pair of substrates and includes n×m pixels, the display section comprising:

a pixel electrode, a counter electrode which faces the pixel electrode, a pixel switching element which is connected to the first control lines and the second control lines and switches a power supply application state for the pixel electrode, and a pixel memory circuit which is connected to the pixel switching element, a first branched power supply line that supplies power to the pixel electrode;

a second branched power supply line that supplies power to the pixel electrode;

a first stem power supply line that supplies power to the first branched power supply line;

a second stem power supply line that supplies power to the second branched power supply line;

a pixel electrode switching circuit that switches a connection state between the first and second branched power supply lines and the pixel electrode according to content which is stored in the pixel memory circuit;

a power supply line switching circuit that is connected between the first and second stem power supply lines and the first and second branched power supply lines, and that selects the connection state between the first and second stem power supply lines and the first and second branched power supply lines;

a control circuit that disconnects or connects the first and second stem power supply lines from or to the first and second branched power supply lines according to whether or not the content which is stored in the pixel memory circuit is rewritten;

a connection circuit that causes at least one of the first branched power supply line and the second branched power supply line, in a disconnection state from the first stem power supply line or the second stem power supply line, to be connected to a common power supply line which is connected to the common electrode; and a scanning line driving circuit that outputs a signal to the second control lines, wherein the scanning line driving circuit is arranged in a predetermined end side of the display section, and the power supply line switching circuit is arranged on another end side which is different from the predetermined end side of the display section.

2. The storage type display device according to claim 1, wherein the scanning line driving circuit and the power supply line switching circuit are arranged through the display section along a row direction.

3. An electronic apparatus comprising the storage type display device according to claim 2.

4. The storage type display device according to claim 1, wherein the power supply line switching circuit is connected between the first and second stem power supply lines and the first and second branched power supply lines for each of a plurality of rows, and selects the connection state between the first and second stem power supply lines and the first and second branched power supply lines in each of the plurality of rows, and the control circuit disconnects or connects the first and second stem power supply lines from or to the first and second branched power supply lines for each of the plurality of rows according to whether or not the content which is stored in the pixel memory circuit is rewritten.

5. The storage type display device according, to claim 1, further comprising:

first power supply lines that are connected to high potential power supply terminals of the pixel memory circuit;

second power supply lines that are connected to low potential power supply terminals of the pixel memory circuit;

a first common power supply line to which the first power supply lines are connected; and a second common power supply line to which the second power supply lines are connected, wherein at least any one of the first common power supply line and the second common power supply line are commonly used for two adjacent pixels in the row direction.

6. The storage type display device according to claim 1, wherein the pixel memory circuit is a capacitor.

7. The storage type display device according to claim 1, wherein the pixel memory circuit includes a latch circuit.

8. The storage type display device according to claim 1, wherein the power supply line switching circuit includes a transfer gate.

9. The storage type display device according to claim 1, further comprising:

a power supply line memory circuit that is connected to the power supply line switching circuit, and is configured to determine a driving state of the power supply line switching circuit; and a reset circuit that resets content of the power supply line memory circuit.

10. The storage type display device according to claim 1, further comprising:

a memory switching element that switches the connection state between a power supply line selection signal line, which is connected to the second control lines and supplies a voltage to be written into a power supply line memory circuit in a reset circuit, and the power supply line memory circuit; and a gate enabling circuit that disconnects the pixel switching element from the second control lines in a case in which the power supply line memory circuit and the power supply line selection signal line are in a connection state by the memory switching element.

11. An electronic apparatus comprising the storage type display device according to claim 1.

12. A storage type display device comprising:

first control lines that are provided in as many as n (n is an integer which is equal to or larger than 2) columns;

second control lines that are provided in as many as m (m is an integer which is equal to or larger than 2) rows; and a display section that includes display elements interposed between a pair of substrates and includes n×m pixels, the display section comprising:

a pixel electrode, a counter electrode which faces pixel electrode, a pixel switching element which is connected to the first control lines and the second control lines and switches a power supply application state for the pixel electrode, and a pixel memory circuit which is connected to the pixel switching element, a branched power supply line that supplies power to the pixel electrode in each row;

a stem power supply line that supplies power to the branched power supply line which is commonly provided for the branched power supply line in each row;

a pixel electrode switching circuit that switches a connection state between the branched power supply line and the pixel electrode according to content which is stored in the pixel memory circuit;

a power supply line switching circuit that is connected between the stem power supply line and the branched power supply line, and that is configured to include a plurality of unit power supply line switching circuits which select connection states between the stem power supply line and the branched power supply line; and a control circuit that disconnects or connects the stem power supply line from or to the branched power supply line according to whether or not the content which is stored in the pixel memory circuit is rewritten, and wherein the unit power supply line switching circuits are respectively arranged on one end side and the other end side of the display section in the row direction, and the unit power supply line switching circuits, which are arranged on one end side and the other end side, are connected to the branched power supply line on the same row.

13. An electronic apparatus comprising the storage type display device according to claim 12.

14. A storage type display device comprising:

first control lines that are provided in as many as n (n is an integer which is equal to or larger than 2) columns;

second control lines that are provided in as many as m (m is an integer which is equal to or larger than 2) rows; and a display section that includes display elements interposed between a pair of substrates and includes n×m pixels, the display section comprising:

a pixel electrode, a counter electrode which faces the pixel electrode, a pixel switching element which is connected to the first control lines and the second control lines and switches a power supply application state for the pixel electrode, and a pixel memory circuit which is connected to the pixel switching element, a branched power supply line that supplies power to the pixel electrode in each row;

a stem power supply line that supplies power to the branched power supply line which is commonly provided for the branched power supply line in each row;

a pixel electrode switching circuit that switches a connection state between the branched power supply line and the pixel electrode according to content which is stored in the pixel memory circuit;

a power supply line switching circuit that is connected between the stem power supply line and the branched power supply line, and that is configured to include a plurality of unit power supply line switching circuits which select connection states between the stem power supply line and the branched power supply line; and a control circuit that disconnects or connects the stem power supply line from or to the branched power supply line according to whether or not the content which is stored in the pixel memory circuit is rewritten, and wherein the unit power supply line switching circuits are arranged on one end side and the other end side of the display section in a row direction, and one unit power supply line switching circuit is provided to the branched power supply line.

15. The storage type display device according to claim 14 wherein the unit power supply line switching circuits are alternately arranged on one end side and the other end side of the display section in the row direction.

16. An electronic apparatus comprising the storage type display device according to claim 15.

17. An electronic apparatus comprising the storage type display device according to claim 14.

18. A storage type display device comprising:

first control lines that are provided in as many as n (n is an integer which is equal to or larger than 2) columns;

second control lines that are provided in as many as m (m is an integer which is equal to or larger than 2) rows; and a display section that includes display elements interposed between a pair of substrates and includes n×m pixels, the display section comprising:

a pixel electrode, a counter electrode which faces the pixel electrode, a pixel switching element which is connected to the first control lines and the second control lines and switches a power supply application state for the pixel electrode, and a pixel memory circuit which is connected to the pixel switching element, a plurality of branched power supply lines that supply power to the pixel electrode in each row, where each row includes at least one branched power supply line of the plurality of branched power supply lines;

a stem power supply line that supplies power to the plurality of branched power supply lines and which is commonly provided for the at least one branched power supply line in each row;

a pixel electrode switching circuit that switches a connection state between the at least one branched power supply line and the pixel electrode according to content which is stored in the pixel memory circuit;

a power supply line switching circuit that is connected between the stem power supply line and the plurality of branched power supply lines and that includes a plurality of unit power supply line switching circuits which select connection states between the stem power supply line and the plurality of branched power supply lines;

a control circuit that disconnects or connects the stem power supply line from or to each of the plurality of branched power supply lines according to whether or not the content which is stored in the pixel memory circuit is rewritten, and a connection circuit that causes the at least one branched power supply line included in each row, in a disconnection state for the stem power supply line, to be connected to a common power supply line which is connected to the common electrode;

wherein each unit power supply line switching circuit of the plurality of unit power supply line switching circuits is connected to the branched power supply lines of two or more rows.

* * * * *